US007384903B2

(12) United States Patent
Masschelein et al.

(10) Patent No.: US 7,384,903 B2
(45) Date of Patent: Jun. 10, 2008

(54) FABRIC CARE AND PERFUME COMPOSITIONS AND SYSTEMS COMPRISING CATIONIC SILICONES AND METHODS EMPLOYING SAME

(75) Inventors: Axel Masschelein, Brussels (BE); Patrick Firmin August Delplancke, Destelbergen (BE); Ivo Salden, Meeuwen-Gruitrode (BE); Jean-Pol Boutique, Gembloux (BE); James Pyott Johnston, Merchtem (BE); Mark Allen Smerznak, Brussels (BE); Walter August Maria Broeckx, Berlare (BE); Ingrid Merere, Brussels (BE); Rafael Trujillo Rosaldo, Waterloo (BE)

(73) Assignee: The Procter & Gamble Company, Cincinnati, OH (US)

( * ) Notice: Subject to any disclaimer, the term of this patent is extended or adjusted under 35 U.S.C. 154(b) by 431 days.

(21) Appl. No.: 11/040,038

(22) Filed: Jan. 21, 2005

(65) Prior Publication Data

US 2005/0164900 A1 Jul. 28, 2005

Related U.S. Application Data

(63) Continuation of application No. 09/935,927, filed on Aug. 23, 2001, now Pat. No. 6,903,061.

(60) Provisional application No. 60/268,174, filed on Feb. 12, 2001, provisional application No. 60/249,059, filed on Nov. 15, 2000, provisional application No. 60/243,825, filed on Oct. 27, 2000, provisional application No. 60/228,170, filed on Aug. 28, 2000.

(51) Int. Cl.
*C11D 1/62* (2006.01)
*C11D 9/36* (2006.01)

(52) U.S. Cl. ..... 510/330; 510/276; 510/308; 510/329; 510/466; 510/504; 510/515; 510/516

(58) Field of Classification Search ..... 510/330, 510/276, 308, 329, 466, 504, 515, 516
See application file for complete search history.

(56) References Cited

U.S. PATENT DOCUMENTS

| | | | |
|---|---|---|---|
| 4,818,242 | A | 4/1989 | Burmeister et al. |
| 5,336,419 | A | 8/1994 | Coffindaffer et al. |
| 5,707,435 | A | 1/1998 | Halloran |
| 6,114,299 | A | 9/2000 | Hunter et al. |
| 6,706,680 | B2 | 3/2004 | Fender et al. |

FOREIGN PATENT DOCUMENTS

| | | | |
|---|---|---|---|
| CA | 2320500 | * | 3/2001 |
| DE | 19853720 | * | 5/2000 |
| EP | 0 394 689 | A | 10/1990 |
| EP | 0 450 816 | A | 10/1991 |
| FR | 2 774 382 | A | 8/1999 |
| GB | 1 549 180 | | 7/1979 |
| WO | WO 99/32539 | | 7/1999 |

OTHER PUBLICATIONS www.goldschmidtsurfactants.com—Fabric Care, REWOQUAT SQ1: The New "Easy Ironing", "Anti-Wrinkle" Formula, 8 pages, no date available.

* cited by examiner

*Primary Examiner*—Charles Boyer
(74) *Attorney, Agent, or Firm*—Armina E. Matthews; Kim William Zerby

(57) ABSTRACT

Systems, compositions and methods for domestic laundering comprising selected cationic silicones.

9 Claims, No Drawings

FABRIC CARE AND PERFUME COMPOSITIONS AND SYSTEMS COMPRISING CATIONIC SILICONES AND METHODS EMPLOYING SAME

CROSS REFERENCE TO REALATED APPLICATIONS

This application is a Continuation of U.S. application Ser. No. 09/935,927, filed Aug. 23, 2001, now U.S. Pat. No. 6,903,061 and claims priority under 37 U.S.C. § 119(e) to U.S. Provisional Application Ser. Nos. 60/228,170, filed Aug. 28, 2000, 60/243,825, filed Oct. 27, 2000, 60/249,059, filed Nov. 15, 2000, and 60/268,174, filed Feb. 12, 2001.

FIELD OF THE INVENTION

This invention relates to systems, compositions and methods for domestic laundering comprising selected cationic silicones formulated for improved fabric care.

BACKGAROUND OF THE INVENTION

When consumers launder fabrics, they desire excellence in cleaning, but also seek superior fabric care or garment care. Such care can be exemplified by one or more of: superior garment appearance; excellent tactile characteristics, such as fabric feel; fabric softness; reduction, removal or prevention of creases or wrinkles in garments; superior ease of ironing; garment shape retention and/or shape recovery; and fabric elasticity.

In home laundering, there exist unique and significant challenges for securing fabric care, especially when compared to industrial textile finishing.

In spite of the advances in the art, there remains a need for improved fabric care, especially in home laundering. In particular, there remain important unsolved problems with respect to selecting cationic silicones and other adjuncts so that the combination provides uncompromised levels of fabric care. When the composition is a laundry detergent, it remains particularly difficult to combine detergent adjuncts and selected cationic silicones in such a way as to secure superior fabric care at the same time as outstanding cleaning and formulation stability or flexibility.

Accordingly, objects of the present invention include to solve the hereinabove mentioned technical problems and to provide systems, compositions and methods having specifically selected cationic silicones and other adjuncts that secure superior fabric care.

SUMMARY OF THE INVENTION

The present invention solves the above-identified technical problems. Specifically, the objects herein are secured and compositions, systems and methods are provided which deliver superior fabric care in home laundering.

An essential component of the invention is the selection of specific cationic silicones, identified in detail hereinafter, which have the potential to deliver superior fabric care in home laundering.

No less important in the present invention is the successful incorporation of the selected silicones in compositions, systems and methods for home fabric care.

The present invention has numerous advantages, including, according to the specific embodiment, one or more aspects of superior fabric care or garment care as exemplified by one or more of: superior garment appearance; excellent tactile characteristics, superior fabric feel; fabric softness; reduction, removal or prevention of creases or wrinkles in garments; superior ease of ironing; garment shape retention and/or shape recovery; and fabric elasticity. Moreover the invention has other advantages, depending on the precise embodiment, which include superior formulation flexibility and/or formulation stability of the home laundry compositions provided.

The invention includes other ramifications, such as processes or methods for securing the compositions, and products in a wide range of forms and types, such as unitary liquid laundry detergents as well as multi-compartment formulations for mixing at the point of use.

The present invention includes surprising discoveries, for example it has surprisingly been found that, given proper attention both to the selection of the cationic silicone and to the formulation adjuncts, unexpectedly good fabric care and/or consumer acceptance of the home laundry product can be obtained, possibly relating to the interplay of multiple fabric care benefits, or to the combination of fabric care and other aesthetic benefits, for example enhanced deposition of otherwise known perfiimery materials. Moreover, superior fabric care or garment care benefits in home laundering as discovered in the present invention can unexpectedly include benefits when the products herein are used in different modes, such as treatment before washing in an automatic washing machine (pretreatment benefits), through-the wash benefits, and post-treatment benefits, including benefits secured when the inventive products are used in the rinse or in fabric or garment spin-out or drying in, or outside an appliance. Additionally discovered are regimen benefits, i.e., benefits of converting from use of a product system comprising conventional detergents to a product system comprising use of the present inventive compositions and compositions formulated specifically for use therewith.

The invention includes a composition comprising: (I) a cationic silicone polymer comprising one or more polysiloxane, preferably polydimethylsiloxane units, preferably two or more such units and one or more, preferably two or more quaternary nitrogen moieties, the latter two or more quaternary nitrogen moieties preferably covalently connected to form an organosilicon-free moiety or moieties wherein each organosilicon-free moiety comprises two or more quaternary nitrogen atoms. The invention encompasses embodiments in which the cationic silicone polymer is novel, see especially Structure 2 hereinafter.

Moreover, when the selected cationic silicone polymer is known from the art, as well as in preferred embodiments of the invention, the composition also comprises (II) one or more laundry adjunct agents selected from the group consisting of: (a) a stabilizer, preferably a thickening stabilizer, more preferably a crystalline, hydroxylontaining stabilizing agent, more preferably still, a trihydroxystearin, hydrogenated oil or a variation thereof; (b) a nitrogen-free nonionic surfactant; (c) a nitrogen-containing detersive surfactant, preferably selected from cationic nitrogen-containing detersive surfactants, amine oxide surfactants, amine and amide-functional detersive surfactants (the latter including fatty amidoalkylamines) and mixtures thereof; (d) a coupling agent, preferably a member selected from the group consisting of fatty amines, 1,4-cyclohexanedimethanol and mixtures thereof; (e) a detergent builder, preferably selected from water-soluble organic builders; (f) a fabric substantive perfume; (g) a scavenger agent selected to capture fugitive dyes and/or anionic surfactants and/or soils, said scavenger agent being selected from the group consisting of fixing agents for anionic dyes, complexing agents for anionic surfactants, clay soil control agents and mixtures thereof; (h) a fabric softener; (i) a detersive enzyme; 0) a chelant; (k) a solvent system; (1) an effervescent system; (m) a coating or encapsulating agent and (n) mixtures thereof.

Preferred embodiments of the invention include a composition comprising from about 0.001% to about 10%, preferably from about 0.001% to about 5% by weight of composition of the cationic silicone and in addition, in total, at least about 1%, preferably at least about 10% of the composition, of laundry adjunct agents, in one embodiment comprising at least a stabilizer; in another embodiment a stabilizer and a builder; in another embodiment at least a builder and a fabric softener; in another embodiment at least a builder and a scavenger agent and in yet another embodiment at least one of said combinations with, in addition, a solvent system comprising water and at least one, preferably two organic solvents or an organic solvent and a coupling agent.

More preferred embodiments of the invention include a composition having at least about 0.01% preferably from about 0.01% to about 20% by weight of the cationic silicone and in addition each of a crystalline, hydroxyl-containing stabilizing agent; a nitrogen-free nonionic detersive surfactant; a fixing agent for anionic dyes; a solvent system comprising water and an organic solvent; and a detergent builder. Surprisingly this combination can further be combined with anionic surfactants and/or soap.

Other preferred embodiments include a composition having the cationic silicone and in addition one of, preferably at least two of: a stabilizer for the cationic silicone; a fabric substantive perfume; a scavenger agent selected to capture fugitive dyes and/or anionic surfactants; and an effervescent system.

Preferred methods herein include a method suitable for use in the home, of treating fabrics, especially in the form of a laundry bundle of garments comprising a heterogeneous combination of fiber and fabric types, with a composition of the invention.

The objects, features and advantages of the invention are further borne out in the following detailed description, examples and appended claims.

All percentages, ratios and proportions herein are on a weight basis based on an undiluted composition, unless otherwise indicated. All documents cited herein are hereby incorporated by reference.

DETAILED DESCRIPTION OF THE INVENTION

Definitions—The terms "Cationic silicone polymer" and "cationic silicone" are used interchangeably to refer to the selected silicones which are an essential component of the invention. Preferred cationic silicones may be designated more particularly, including for example "water-immiscible cationic silicone random block copolymers". Cationic silicone polymers in accordance with the inventive selection are defined fully hereinafter.

"System" as used herein means a unity formed of a plurality of parts subject to a common plan or serving a common purpose. The parts can be materials, compositions, devices, appliances, procedures, methods, or conditions. Diverse parts and/or diverse types of parts can characterize different systems.

The term "adjunct", as used herein, refers to any liquid, solid or gaseous material selected for use with the cationic silicone polymers in the present compositions. Adjuncts are preferably, but not necessarily inherently compatible with the cationic silicone polymer and with other ingredients present in compositions of the present invention. When adjuncts are not inherently compatible, they may be included through various techniques such as changing the order of addition in making processes, through encapsulation, through the use of multi-part compositions to be mixed at the point of use, and the like.

"Treated Substrate" as used herein means a substrate, especially a fabric or garment, having one or more of the fabric care benefits described herein as imparted thereto by a composition having the selected cationic silicones of the invention.

The term "divalent" as used in phrases such as "divalent moiety" or "divalent hydrocarbyl" refers to a moiety having two covalent vanencies available for connecting it to the structure. For example, $—(CH_2)_6—$ is such a moiety.

An "effective amount", preferably from about 0.01%, more preferably from about 0.1%, even more preferably from about 1% to about 20%, more preferably to about 15%, even more preferably to about 10%, still even more preferably to about 7%, most preferably to about 5% by weight of the fabric care compositions of one or more cationic silicone polymers of the present invention is included in compositions useful for laundering and/or perfuming a variety of fabrics in need of treatment. As used herein, "effective amount" of a material or composition is the amnount needed to accomplish an intended purpose, for example, to impart a desired level of fabric care benefit to a fabric article/substrate.

Form of the Compositions—The compositions, especially the fabric care compositions of the present invention, may be in any form, such as liquids (aqueous or non-aqueous), granules, pastes, powders, sprays, foams, tablets, gels, and the like. Encapsulated and/or unitized dose compositions are included, as are compositions which form two or more separate but combinedly dispensable portions. Granular compositions can be in "compact" or "low density" form and the liquid compositions can also be in a "concentrated" or diluted form. Preferred fabric care compositions of the present invention include liquids, more preferably heavy duty liquid fabric care compositions and liquid detergents for washing fine fabrics including silk, wool and the like. Compositions formed by mixing the provided compositions with water in widely ranging proportions are included.

The fabric care compositions and/or perfume compositions of the present invention may be in the form of spray compositions, preferably contained within a suitable spray dispenser.

Uses of Compositions of the Invention in Relation to Form—As used herein, "fabric care compositions" include fabric care compositions for handwash, machine wash and other purposes including fabric care additive compositions and compositions suitable for use in the soaking and/or pretreatment of stained fabrics.

Even though fabric care compositions are specifically discussed herein, compositions comprising the cationic silicones of the present invention for use in treating, cleaning, conditioning, and/or refreshing both natural and synthetic fibers are encompassed by the present invention.

Perfume compositions—The present compositions include perfume compositions of the present invention which comprise a fabric substantive perfume as defined in full hereinafter and a cationic silicone polymer as taught for use in the present laundry or fabric care compositions.

The perfume compositions of the present invention are preferably incorporated into the fabric care compositions of the present invention. For example, the perfume compositions of the present invention may be premixed prior to adding to the fabric care compositions of the present invention.

The level of perfume composition in the fabric care composition is typically from about 0.0001% to about 2% or higher, e.g., to about 10%; preferably from about 0.0002% to about 0.8%, more preferably from about 0.003% to about 0.6%, most preferably from about 0.005% to about 0.5% by weight of the fabric care composition.

The level of fabric substantive perfume ingredients in the perfume compositions of the present invention is typically from about 0.0001% (more preferably 0.01%) to about 99%, preferably from about 0.01% to about 50%, more preferably from about 0.2% to about 30%, even more preferably from about 1% to about 20%, most preferably from about 2% to about 10% by weight of the composition of the perfume composition.

Cationic silicone—The cationic silicone polymer selected for use in the present invention compositions comprises one or more polysiloxane units, preferably polydimethylsiloxane units of formula —$\{(CH_3)_2SiO\}_n$— having a degree of polymerization, n, of from 50 to 200 and organosilicon-free units comprising at least one diquatemary unit. In preferred embodiments of the invention, the selected cationic silicone polymer has from 0.50 to 1.0 weight fraction of said organosilicon-free units selected from N,N,N',N'-tetramethyl-1,6-hexanediammonium units.

The selected cationic silicone polymer can also contain from 0.0 to 0.20 weight fraction, in certain embodiments a non-zero amount, of the total of organosilicon-free units of —$NHCH(CH_3)CH_2O(AO)_aCH_2CH(CH_3)NH$— units wherein AO represents ethyleneoxy, propyleneoxy, butyleneoxy and mixtures thereof and a is from 5 to 70.

The selected cationic silicone polymer can also contain from 0.0, in certain embodiments a non-zero amount to 0.20 weight fraction, of the total of organosilicon-free units of —$NR_3$+ wherein R is alkyl, hydroxyalkyl or phenyl. These units can be thought of as end-caps.

Moreover the selected cationic silicone polymer generally contains anions, selected from inorganic and organic anions, more preferably selected from saturated and unsaturated $C_1$-$C_{20}$ carboxylates and mixtures thereof, to balance the charge of the quaternary moieties, thus the cationic silicone polymer also comprises such anions in a quatemary charge-balancing proportion.

Conceptually, the selected cationic silicone polymers herein can helpfully be thought of as non-crosslinked or "linear" block copolymers including non-fabric-substantive but surface energy modifying "loops" made up of the polysiloxane units, and fabric-substantive "hooks". One preferred class of the selected cationic polymers (illustrated by Structure 1 hereinafter) can be thought of as comprising a single loop and two hooks; another, very highly preferred, comprises two or more, preferably three or more "loops" and two or more, preferably three or more "hooks" (illustrated by Structures 2a and 2b hereinafter), and yet another (illustrated by Structure 3 hereinafter) comprises two "loops" pendant from a single "hook".

Of particular interest in the present selection of cationic silicone polymers is that the "hooks" contain no silicon and that each "hook" comprises at least two quaternary nitrogen atoms.

Also of interest in the present selection of preferred cationic silicone polymers is that the quaternary nitrogen is preferentially located in the "backbone" of the "linear" polymer, in contradistinction from alternate and less preferred structures in which the quaternary nitrogen is incorporated into a moiety or moieties which form a "pendant" or "dangling" structure off the "backbone".

The structures are completed by terminal moieties which can be noncharged or, when charged, can comprise only one quaternary nitrogen atom, as in the moiety —$NR_3$+ wherein R is alkyl. Moreover a certain proportion of nonquatemary silicone-free moieties can be present, for example the moiety —$NHCH(CH_3)CH_2O(AO)_aCH_2CH(CH_3)NH$-described hereinabove.

Of course the conceptual model presented is not intended to be limiting of other moieties, for example connector moieties, which can be present in the selected cationic silicone polymers provided that they do not substantially disrupt the intended function as fabric benefit agents.

In more detail, the cationic silicone polymers herein have one or more polysiloxane units and one or more quaternary nitrogen moieties, including polymers wherein the cationic silicone polymer has the formula: (Structure 1)

STRUCTURE 1

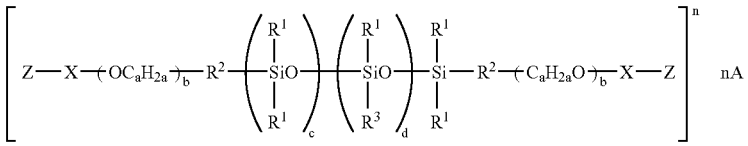

wherein:

$R^1$ is independently selected from the group consisting of: $C_{1-22}$ alkyl, $C_{2-22}$ alkenyl, $C_{6-22}$ alkylaryl, aryl, cycloalkyl and mixtures thereof;

$R^2$ is independently selected from the group consisting of: divalent organic moieties that may contain one or more oxygen atoms (such moieties preferably consist essentially of C and H or of C, H and O);

X is independently selected from the group consisting of ring-opened epoxides;

$R^3$ is independently selected from polyether groups having the formula:

$-M^1(C_aH_{2a}O)_b-M^2$ wherein $M^1$ is a divalent hydrocarbon residue; $M^2$ is H, $C_{1-22}$ alkyl, $C_{2-22}$ alkenyl, $C_{6-22}$ alkylaryl, aryl; cycloalkyl, $C_{1-22}$ hydroxyalkyl, polyalkyleneoxide or (poly)alkoxy alkyl;

Z is independently selected from the group consisting of monovalent organic moieties comprising at least one quatemized nitrogen atom;

a is from 2-4; —b is from 0-100; —c is from 1-1000, preferably greater than 20, more preferably greater than 30, even more preferably greater than 50, preferably less than 500, more preferably less than 300, even more preferably less than 200, most preferably from about 70 to about 100; —d is from 0-100; —n is the number of positive charges associated with the cationic silicone polymer, which is greater than or equal to 2; and —A is a monovalent anion.

In a preferred embodiment of the Structure 1 cationic silicone polymers, Z is independently selected from the group consisting of:

(i)

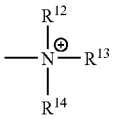

(ii)

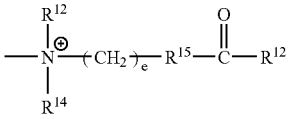

(iii)

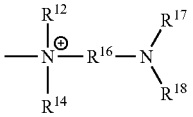

(iv)

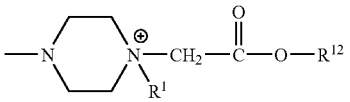

(v) monovalent aromatic or aliphatic heterocyclic group, substituted or unsubstituted, contanig at least one quateniizd nitrogen atom;

wherein:

$R^{12}$, $R^{13}$, $R^{14}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyaikyleneoxide; (poly)alkoxy alkyl, and mixtures thereof, $R^{15}$ is —O— or $NR^{19}$;

$R^{16}$ is a divalent hydrocarbon residue;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl and mixtures thereof; and e is from 1 to 6.

In a highly preferred embodiment, the cationic silicone polymers herein have one or more polysiloxane units and one or more quaternary nitrogen moieties, including polymers wherein the cationic silicone polymer has the formula: (Structure 2a)

STRUCTURE 2a: Cationic silicone polymer composed of alternating units of:

(i) a polysiloxane of the following formula

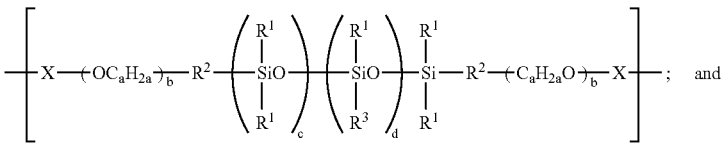

; and (ii) a divalent organic moiety comprising at least two quaternized nitrogen atoms.

Note that Structure 2a comprises the alternating combination of both the polysiloxane of the depicted formula and the divalent organic moiety, and that the divalent organic moiety is organosilicon-free corresponding to a preferred "hook" in the above description.

In this preferred cationic silicone polymer, $R^1$ is independently selected from the group consisting of: $C_{1-22}$ alkyl, $C_{2-22}$ alkenyl, $C_{6-22}$ alkylaryl, aryl, cycloalkyl and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$-M^1(C_aH_{2a}O)_bM^2$$

wherein $M^1$ is a divalent hydrocarbon residue; $M^2$ is H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide or (poly)alkoxy alkyl;

a is from 2-4; —b is from 0-100;—c is from 1-1000, preferably greater than 20, more preferably greater than 30, even more preferably greater than 50, preferably less than 500, more preferably less than 300, even more preferably less than 200, most preferably from about 70 to about 100; and —d is from 0-100.

In an even more highly preferred embodiment of the Structure 2a cationic silicone polymer, the cationic silicone polymer has the formula Structure 2b wherein the polysiloxane of the formula described above in Structure 2a is present with a cationic divalent organic moiety selected from the group consisting of:

(a)

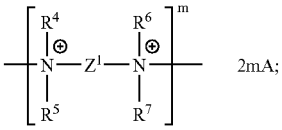

2mA;

(b)

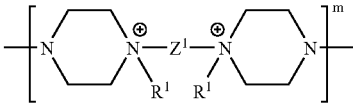

2mA;

(c)

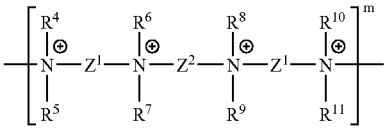

4mA;

(d) a divalent aromatic or aliphatic heterocyclc group, substituted or unsubsttuted, containing at least one quatenized nitrogent atom; and (iii) optionally, a polyalkyleneoxide of formula:

$$[Y—O—(C_aH_{2a}O)_b—Y];\ \text{and}$$

(iv) optionally, a cationic monovalent organic moiety, to be used as an end-group, selected from the group consisting of:

(i)

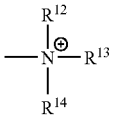

(ii)

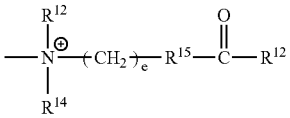

(iii)

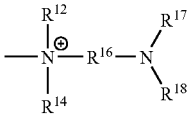

(iv)

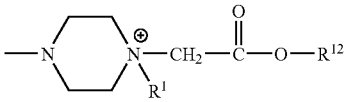

(v) monovalent aromatic or alphatic heterocyclic group, substituted or unsubsttuted, containing at least one quaterirzed nitrogen atom;

wherein:

$R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl and mixtures thereof, or in which $R^4$ and $R^6$, or $R^5$ and $R^7$, or $R^8$ and $R^{10}$, or $R^9$ and $R^{11}$ may be components of a bridging alkylene group;

$R^{12}$, $R^{13}$, $R^{14}$ are the same or different, and are selected from the group consisting of: $C_{1-22}$ alkyl; $C_{2-22}$ alkenyl; $C_{6-22}$ alkylaryl; $C_{1-22}$ hydroxyalkyl; polyalkyleneoxide; (poly)alkoxy alkyl groups and mixtures thereof, and $R^{15}$ is —O— or $NR^{19}$;

$R^{16}$ and $M^1$ are the same or different divalent hydrocarbon residues;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl, and mixtures thereof; and $Z^1$ and $Z^2$ are the same or different divalent hydrocarbon groups with at least 2 carbon atoms, optionally containing a hydroxy group, and which may be interrupted by one or several ether, ester or amide groups;

Y is a secondary or tertiary amine;

e is from 1-6;

m is the number of positive charges associated with the cationic divalent organic moiety, which is greater than or equal to 2; and A is an anion.

Note that Structure 2b comprises the alternating combination of both the polysiloxane of the depicted formula and the divalent organic moiety, and that the divalent organic moiety is organosilicon-free corresponding to a preferred "hook" in the above general description. Structure 2b moreover includes embodiments in which the optional polyalkyleneoxy and/or end group moieties are either present or absent.

In yet another embodiment, the cationic silicone polymers herein have one or more polysiloxane units and one or more quaternary nitrogen moieties, and including polymers wherein the cationic silicone polymer has the formula: (Structure 3)

STRUCTURE 3

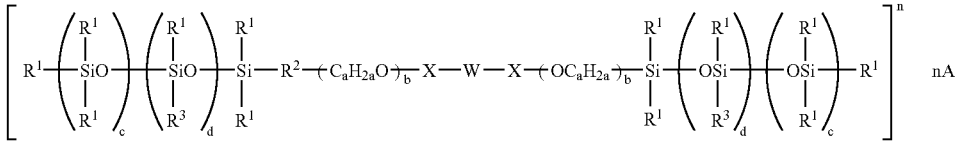

wherein:

$R^1$ is independently selected from the group consisting of: $C_{1-22}$ alkyl; $C_{2-22}$ alkenyl; $C_{6-22}$ alkylaryl; aryl; cycloalkyl and mixtures thereof, $R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$-M^1(C_aH_{2a}O)_bM^2$$

wherein $M^1$ is a divalent hydrocarbon residue; $M^2$ is H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide or (poly)alkoxy alkyl;

X is independently selected from the group consisting of ring-opened epoxides;

W is independently selected from the group consisting of divalent organic moieties comprising at least one quaternized nitrogen atom a is from 24;

b is from 0-100;

c is from 1-1000, preferably greater than 20, more preferably greater than 30, even more preferably greater than 50, preferably less than 500, more preferably less than 300, even more preferably less than 200, most preferably from about 70 to about 100;

d is from 0-100;

n is the number of positive charges associated with the cationic silicone polymer, which is greater than or equal to 1; and A is a monovalent anion, in other words, a suitable couterion.

In preferred cationic silicone polymers of Structure 3, W is selected from the group consisting of:

(a)

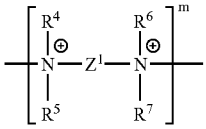

2mA;

(b)

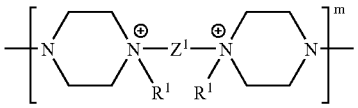

2mA;

(c)

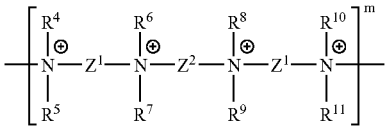

4mA;

(d) a dwalent aromatic or alipbatic heterocyclic group, substituted or unsubstituted, containing at least one quate-izd nitrogent atole; and $R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl, and mixtures thereof; or in which $R^4$ and $R^6$, or $R^5$ and $R^7$, or $R^8$ and $R^{10}$, or $R^9$ and $R^{11}$ may be components of a bridging alkylene group; and $Z^1$ and $Z^2$ are the same or different divalent hydrocarbon groups with at least 2 carbon atoms, optionally containing a hydroxy group, and which may be interrupted by one or several ether, ester or amide groups.

SYNTHESIS EXAMPLE

When not otherwise known or available in commerce, the cationic silicone polymers herein can be prepared by conventional techniques. The following are non-limiting examples of processes for makcing the cationic polymers of the present invention.

Example 1

The epoxysiloxane having the formula:

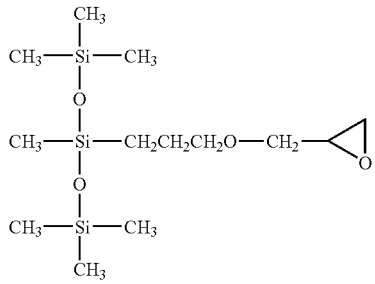

(33.7 g, 0.1 mol) and N-methylpiperizine are combined in isopropanol (40 mL) and refluxed for 7 hours after which the solvent is removed in vacuo to afford in nearly quantitative yield a an aminosiloxane having the formula:

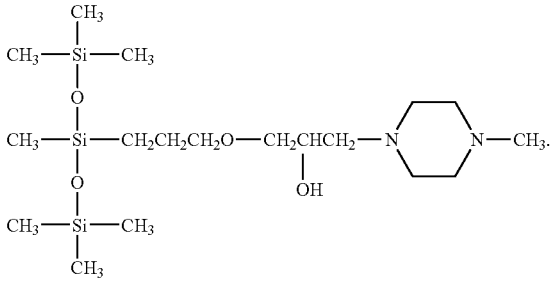

Propargyl alcohol (497 g, 8.87 mol) was stirred under nitrogen at room temperature while over the period of 1 hour α-chloroacetyl chloride (955 g, 8.45 mole) is added dropwise. During the addition the temperature rises to 60° C. with intense formation of HCl gas. The mixture darkens and is heated for 1 hour at 130° C. Fractional distillation yields 891 g of propargyl α-chloroacetate BP 179-181° C.

Propargyl α-chloroacetate (26.5 g, 0.2 mole) and Lamoreaux supported catalyst (44 mg) containing 3.43% Pt, according to U.S. Pat. No. 3,220,972 are combined under nitrogen at room temperature. Over 30 minutes 1,1,1,3,5,5,5-heptamethyl trisiloxane is added ant the temperature raised to 60° C. then finally heated to 100° C. for 4 hours.

The distillate boiling up to 120° C. as 2 hPa was removed to yield a yellowish liquid (64.5 g) having the formula:

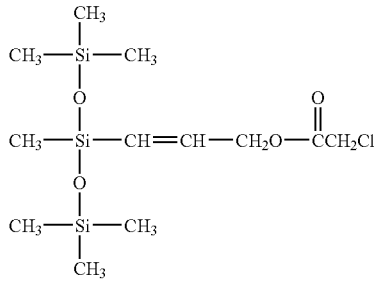

having a purity of 85%.

The piperidine siloxane from above (21.8 g, 0.05 mol) and the chloro ester siloxane (17.7 g, 0.05 mol) are suspended under nitrogen atmosphere in methyl propyl ketone (50 mL) and refluxed for 6 hours. Subsequently the impurities boiling up to 100° C. at 4 hPa were removed to yield 35.7 g of a brown residue having the formula:

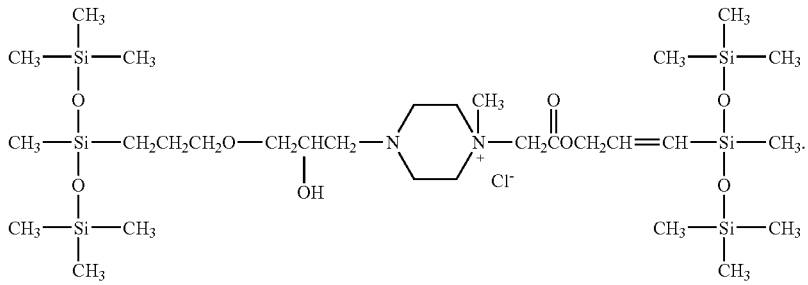

Example 2

An epoxy siloxane (211.1 g, 0.15 mol) having the formula:

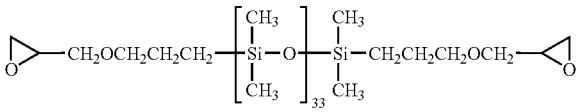

and N-methylpiperazine (15.2 g, 0.15 mol) are combined in isopropanol (225 mL) and heated to 90° ° C. for 4 hours to form an α,ω-aminosiloxane. The solvent is removed by distillation to yield 217 g of a clear product.

To a polyethylene glycol having an average molecular weight of 300 g/mol (an average of 6.4 ethyleneoxy units per molecule) (150 g, 1 mol eq. of —OH units) under nitrogen atmosphere is added over 30 minutes 3-chloropropionic acid chloride (152.4 g, 1.2 mol). The temperature rises to 70° C. and a profuse liberation of HCl gas ensues. The reaction is continued for 30 minutes at 120° C. after which the impurities boiling up to 120° C. at 20 hPa are removed to yield the compound having the formula:

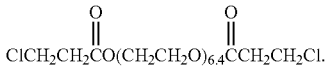

The α,ω-ammnosiloxane (19.61 g, 6.5 mmol) and the α,ω-chloropropionic glycol ester (3.12 g, 6.5 mmol) are combined under nitrogen atmosphere in isopropanol (50 mL) and allowed to reflux for 12 hours. Then the impurities boiling up to 70° C. at 20 hPa are removed to yield 21.6 g of an compound having the formula:

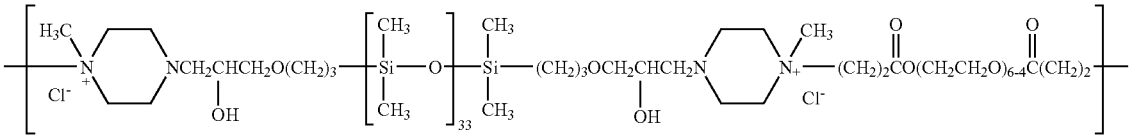

Example 3

An epoxy siloxane (181.3 g, 0.5 mol) having the formula:

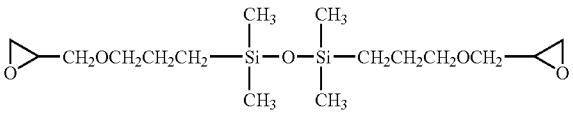

is reacted with N-methylpiperazine (101.2 g, 1 mol) in isopropanol (100 mL). The impurities are distilled off up too 100° C. at 20 hPa to yield a light brown clear residue of 276 g of an α,ω-aininosiloxane. The α,ω-aminosiloxane (6.2 g, 11 mmol) and the α,ω-aminosiloxane from Example B (33.21 g, 11 mmol) are combined with the α,ω-chloropropionic glycol ester from Example B (10.59 g, 22 mmol) and suspended in isopropanol (50 mL) under nitrogen atmosphere and refluxed for 10 hours. The solvent and materials boiling up to 40° C. at 20 hPa are removed to afford 48.7 g of a brown waxy compound having the average formula:

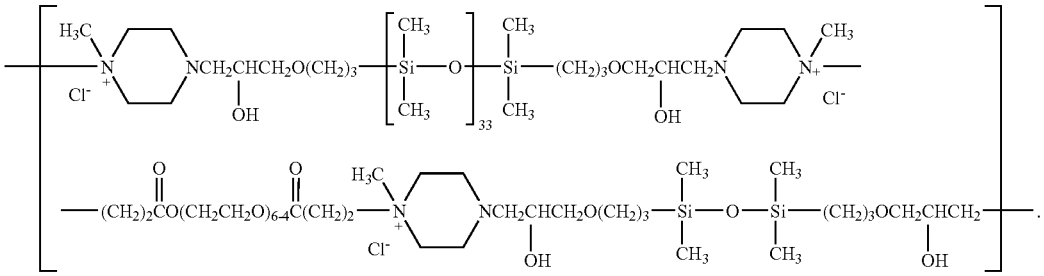

Preferred Fabric Care Adjuncts (a) Stabilizer—Compositions of the present invention may and preferably do include a stabilizer.

Suitable levels of this component are in the range from about 0.01% to about 20%, more preferably from about 0.1% to about 10% by weight of the composition. The stabilizer serves to stabilize the cationic silicone in the inventive compositions and to prevent it from coagulating and/or creaming. This is especially important when the inventive compositions have fluid form, as in the case of perfume compositions, liquid or gel-form laundry detergents for heavy-duty or fine fabric wash use, and liquid or gel-form fabric treatments other than laundry detergents.

Stabilizers suitable for use herein can be selected from thickening stabilizers. These include gums and other similar polysaccharides, for example gellan gum, carrageenan gum, and other known types of thickeners and Theological additives other than highly polyanionic types; thus conventional clays are not included.

More preferably the stabilizer is a crystalline, hydroxyl-containing stabilizing agent, more preferably still, a trihydroxystearin, hydrogenated oil or a variation thereof.

Without intending to be limited by theory, the crystalline, hydroxyl-containing stabilizing agent is a nonlimiting example of a "thread-like structuring system." "Thread-like Structuring System" as used herein means a system comprising one or more agents that are capable of providing a chemical network that reduces the tendency of materials with which they are combined to coalesce and/or phase split. Examples of the one or more agents include crystalline, hydroxyl-containing stabilizing agents and/or hydrogenated jojoba. Surfactants are not included within the definition of the thread-like structuring system. Without wishing to be bound by theory, it is believed that the thread-like structuring system forms a fibrous or entangled threadlike network in-situ on cooling of the matrix. The thread-like structuring system has an average aspect ratio of from about 1.5:1, preferably from at least about 10:1, to about 200:1.

The thread-like structuring system can be made to have a viscosity of about 2000 cps or less at an intermediate shear range (5 s−1 to 50 s−1) which allows for the pouring of the detergent out of a standard bottle, while the low shear viscosity of the product at 0.1 s−1 can be at least about 2000 cps but more preferably greater than about 20,000 cps.

The thread-like structuring system of the present invention provides the liquid compositions of the present invention improved shelf and stress stability, but allows the liquid compositions to permit its benefit-providing agents to provide their benefits upon use. The specific system used is found to be compatible with the cationic silicones, whereas others, for example when comprised substantially of clays such as sodium montmorillonite, are not.

The process for making the thread-like structuring system of the present invention suitably comprises heating a mixture of water and a crystalline, hydroxyl-containing stabilizing agent to above the melting point of the crystalline, hydroxyl-containing stabilizing agent, and then cooling the mixture while mixing continuously to room temperature such that a thread-like structuring system is formed.

In one embodiment, the process comprises activating the crystalline, hydroxyl-contning stabilizing agent comprising the steps of: 1) combining the crystalline, hydroxyl-stabilizing agent, preferably from about 0.1% to about 5% by weight of the premix, with water, preferably at least about 20% by weight of the premix, and a surfactant and optionally, a salt, to form a premix; 2) heating the premix formed in Step 1) above the melting point of the crystalline, hydroxyl-containing stabilizing agent; and 3) cooling the mixture formed in Step 2) while agitating the mixture to ambient temperature such that a thread-like structuring system is formed.

The premix formed in Step 1) may further comprise a surfactant.

The premix formed in Step 1) may further comprise an amine oxide. Further detail around this process of making the thread-like structuring system can be found in U.S. Pat. No. 6,080,708, which is owned by The Procter and Gamble Company.

The crystalline, hydroxyl-containing stabilizing agent typically is present in the liquid compositions of the present invention at a level of from about 0.1% to about 10%, more typically from about 0.1% to about 3%, most typically from about 0.3% to about 2% by weight of the liquid composition.

Crystalline, hydroxyl-containing stabilizing agents can be fatty acid, fatty ester or fatty soap water-insoluble wax-like substance.

The crystalline, hydroxyl-containing stabilizing agents in accordance with the present invention are preferably derivatives of castor oil, especially hydrogenated castor oil derivatives. For example, castor wax.

The crystalline, hydroxyl-containing agent typically is selected from the group consisting of:

i) $R^1OCH_2CH(OR^2)CH_2OR^3$ wherein $R^1$ is —C(O)$R^4$, $R^2$ is $R^1$ or H, $R^3$ is $R^1$ or H, and $R^4$ is independently $C_{10}$-$C_{22}$ alkyl or alkenyl comprising at least one hydroxyl group;

ii)

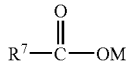

wherein:

$R^7$ is $-\overset{O}{\overset{\|}{C}}-R^4$;

$R^4$ is as defined above in i);

M is $Na^+$, $K^+$, $Mg^{++}$ or $Al^{3+}$, or H; and iii) mixtures thereof.

Alternatively, the crystalline, hydroxyl-containing stabilizing agent may have the formula:

$$CH_3(CH_2)_aCHOH(CH_2)_xC(O)OCH_2CH(O(O)C(CH_2)_y CHOH(CH_2)_bCH_3)CH_2O(O)C(CH_2)_zCHOH (CH_2)_cCH_3$$

wherein:

(x+a) is from between 11 and 17; (y+b) is from between 11 and 17; and (z+c) is from between 11 and 17. Preferably, wherein x=y=z=10 and/or wherein a=b=c=5.

Commercially available crystalline, hydroxyl-containing stabilizing agents include THIXCIN® from Rheox, Inc.

Other less preferred stabilizers useful herein include gum-type polymers (e.g. xanthan gum), polyvinyl alcohol and derivatives thereof, cellulose and derivatives thereof and tamarind gum (preferably consisting of xyloglucan polymers), guar gum, locust bean gum (preferably consisting of galactomannan polymers), and other industrial gums and polymers, which include, but are not limited to, Tara, Fenugreek, Aloe, Chia, Flaxseed, Psyllium seed, quince seed, xanthan, gellan, welan, rhamsan, dextran, curdlan, pullulan, scleroglucan, schizophyllan, chitin, hydroxyalkyl cellulose, arabinan (preferably from sugar beets), de-branched arabinan (preferably from sugar beets), arabinoxylan (preferably from rye and wheat flour), galactan (preferably from lupin and potatoes), pectic galactan (preferably from potatoes), galactomannan (preferably from carob, and including both low and high viscosities), glucomannan, lichenan (preferably from icelandic moss), mannan (preferably from ivory nuts), pachyman, rhamnogalacturonan, acacia gum, agar, alginates, carrageenan, chitosan, clavan, hyaluronic acid, heparin, inulin, cellodextrins, carboxymethylcellulose (CMC), dextrans, dextrins, ethylhydroxyethylcellulose (EHEC), guar, hydroxyethylcellulose (HEC), hydroxypropylcellulose (HPC), hydroxybutylcellulose (HBC), karaya, larch, methylcellulose (MC), tamarind, scleroglucan, xanthan, carboxymethylhydroxyethylcellulose (CMHEC), methoxypropyl methyl cellulose (MPMC), hexylcarboxymethyl cellulose, $C_{12}$-$C_{20}$ alkyl carboxymethylcellulose, methylhydroxyethylcellulose (MHEC), methylhydroxypropylcellulose (MHPC), hydroxyethylmethylcellulose (HEMC), hydroxypropylmethylcellulose (HPMC), hydroxybutylmethylcellulose (HBMC) and mixtures thereof.

The stabilizer is preferably present at a level of from 0.01% to 10%, most preferably from 0.1% to 3%.

(b) Nitrogen-free nonionic surfactant—The present compositions may and preferably do include preferred embodiments incorporating this type of detersive surfactant. Suitable levels of this component are in the range from about 0.01% to about 80%, more typically from about 0.1% to about 50%, preferably from about 1% to about 30% by weight of the composition. Suitable surfactants of this type can be prepared from alkoxylates, including ethylene oxide, propylene oxide, butylene oxide and mixed alkylene oxide condensates of any suitable detergent alcohols having linear of branched hydrocarbyl moieties. Examples include: $C_8$-$C_{18}$ alkyl and/or alkylaryl alkoxylates, especially the ethoxylates, containing from about 1 to 22 moles of ethylene oxide. This includes the so-called narrow peaked alkyl ethoxylates and the $C_6$-$C_{12}$ alkyl phenol eyhoxylates, especially nonylphenyl ethoxylates. The alcohols can be primary, secondary, Guerbet, mid-chain branched, or of any other branched type, especially the more biodegradable types. Commercially available materials can be obtained from Shell Chemical, Condea, or Procter & Gamble. When these surfactants are used, the compositions of the invention will contain up to about 80%, preferably from 1% to about 50%, more preferably from 2% to about 20%, by weight thereof.

Other nonionic surfactants for use herein include, but are not limited to: alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside having a hydrophilic group containing from about 1.3 to about 10 polysaccharaide units. Any reducing saccharide containing 5 or 6 carbon atoms can be used. Optionally the hydrophobic group is attached at the 2-, 3-, 4-, etc. positions thus giving a glucose or galactose as opposed to a glucoside or galactoside. The intersaccharide bonds can be, e.g., between the one position of the additional saccharide units and the 2-, 3-, 4-, and/or 6-positions on the preceding saccharide units. Preferred alkylpolyglycosides have the formula $RO(C_nH_{2n}O)_t(\text{glycosyl})_x$ wherein R is selected from the group consisting of alkyl, alkyl-phenyl, hydroxyalkyl, hydroxyalkylphenyl, and mixtures thereof in which the, alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7, and the glycosyl is preferably derived from glucose.

(c) Nitrogen-containing detersive surfactant—Suitable levels of this component, when present, are in the range from about 0.01% to about 20%, more preferably from about 0.1% to about 15%, typically from about 1% to about 10% by weight of the composition.The nitrogen-containing detersive surfactant herein is preferably selected from cationic nitrogen-containing detersive surfactants, amine oxide surfactants, amine and amide-functional detersive surfactants (including fatty amidoalkylamines) and mixtures thereof. The nitrogen-containing detersive surfactant is typically water-soluble and does not include silicone surfactants. Different surfactants of this type can be combined in varying proportions.

i) Cationic nitrogen containing detersive surfactants—Cationic nitrogen-containing detersive surfactants suitable for use in the compositions of the present invention are typically water-soluble and have at least one quaternized nitrogen and one long-chain hydrocarbyl group. Examples of such cationic surfactants include the water-soluble alkyltrimethylammonium salts or their hydroxyalkyl substituted analogs, preferably compounds having the formula $R_1R_2R_3R_4N^+X^-$ wherein $R_1$ is $C_8$-$C_{16}$ alkyl, each of $R_2$, $R_3$ and $R_4$ is independently $C_1$-$C_4$ alkyl, $C_1$-$C_4$ hydroxy alkyl, benzyl, and $-(C_2H_4O)_xH$ where x has a value from 2 to 5, and X is an anion. Not more than one of $R_2$, $R_3$ or $R_4$ should be benzyl. The preferred alkyl chain length for $R_1$ is $C_{12}$-$C_{15}$. Preferred groups for $R_2$, $R_3$ and $R_4$ are methyl and hydroxyethyl and the anion X may be selected from halide, methosulfate, acetate and phosphate.

ii) Amine Oxide Surfactants—These surfactants have the formula: $R(EO)_x(PO)_y(BO)_zN(O)(CH_2R')_2.qH_2O$ (I). R is a relatively long-chain hydrocarbyl moiety which can be saturated or unsaturated, linear or branched, and can contain from about 8 to about 20, preferably from about 10 to about 16 carbon atoms, and is more preferably C12-C16 primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

iii) Amine and Amide Functional Detersive Surfactants—A preferred group of these surfactants is amine surfactants, preferably an amine surfactant having the formula $RX(CH_2)_xNR^2R^3$ wherein R is $C_6$-$C_{12}$ alkyl; X is a bridging group which is selected from NH, CONH, COO, or O or X can be absent; x is from 2 to 4; $R_2$ and $R_3$ are each independently selected from H, $C_1$-$C_4$ alkyl, or ($CH_2$—$CH_2$—$O(R_4)$) wherein $R_4$ is H or methyl. Particularly preferred surfactants of this type include those selected from the group consisting of decyl amine, dodecyl amine, $C_8$-$C_{12}$ bis(hydroxyethyl)amine, $C_8$-$C_{12}$ bis(hydroxypropyl)amine, $C_8$-$C_{12}$ amido propyl dimethyl amine, and mixtures thereof.

This group of surfactants also includes fatty acid amide surfactants having the formula $RC(O)NR'_2$ wherein R is an alkyl group containing from about 10 to about 20 carbon atoms and each R' is a short-chain moiety preferably selected from the group consisting of hydrogen and $C_1$-$C_4$ alkyl and hydroxyalkyl. The $C_{10}$-$C_{18}$ N-alkyl polyhydroxy fatty acid amides can also be used. Typical examples include the $C_{12}$-$C_{18}$ N-methylglucamides. See WO 92/06154. Other sugar-derived nitrogen-containing nonionic surfactants include the N-alkoxy polyhydroxy fatty acid arnides, such as $C_{10}$-$C_{18}$ N-(3-methoxypropyl)glucamide.

(d) Coupling agent—Coupling agents suitable for use herein include fatty amines other than those which have marked surfactant character or are conventional solvents (such as the lower alkanolamines). Examples of these coupling agents include hexylamine, octylamine, nonylamine and their C1-C3 secondary and tertiary analogs. Levels of this component, when present, are suitably in the range of from about 0.1% to about 20%, more typically about 0.5% to about 5% by weight of the composition.

A particularly useful group of coupling agents is selected from the group consisting of molecules which consist of two polar groups separated from each other by at least 5, preferably 6, aliphatic carbon atoms; preferred compounds in this group are free from nitrogen and include 1,4 Cyclo Hexane Di Methanol (CHDM), 1,6 Hexanediol, 1,7 Heptanediol and mixtures thereof. 1,4 Cyclo Hexane Di Methanol may be present in either its cis configuration, its trans configuration or a mixture of both configurations.

(e) Detergent builder—In general any known detergent builder is useful herein, including inorganic types such as zeolites, layer silicates, and phosphates such as the alkali metal polyphosphates, and organic types including especially the alkali metal salts of citrate, 2,2-oxydisuccinate, carboxymethyloxysuccinate, nitrilotriacetate and the like. Phosphate-free, water-soluble organic builders which have relatively low molecular weight, e.g., below about 1,000, are highly preferred for use herein. Other suitable builders include sodium carbonate and sodium silicates having varying ratios of $SiO_2$:$Na_2O$ content, e.g., 1:1 to 3:1 with 2:1 ratio being typical.

(f) Fabric substantive perfume—The fabric care compositions and perfume compositions of the present invention can comprise perfume to provide a "scent signal" in the form of a pleasant odor which provides a freshness impression to the washed fabrics. The fabric substantive perfume ingredients are suitably at levels in the range from about 0.0001% to about 10% by weight of the composition and are characterized by their boiling points (B.P.). The fabric substantive perfume ingredients have a B.P, measured at the normal, standard pressure of 760 mm Hg, of about 240° C. or higher, and preferably of about 250° C. or higher. Preferably the fabric substantive perfume ingredients have a ClogP of greater than 3, more preferably from about 3 to about 6.

The preferred perfume compositions used in the present invention contain at least 2, preferably at least 3, more preferably at least 4, even more preferably at least 5, even more preferably at least 6, and even more preferably at least 7 different fabric substantive perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

Nonlimiting examples of suitable fabric substantive perfume ingredients for use in the compositions of the present invention include:

2-CYCLOPENTEN-1-ONE, 3-METHYL-2-(2-PENTENYL)-, (Z)-BUTANOIC ACID, 3-METHYL-, 4-METHYLPHENYL ESTER 2(5H)-FURANONE, 3,4-DIMETHYL-5-PENTYLIDENE-BUTANOIC ACID, 3-METHYL-, PHENYLMETHYL ESTER 2-BUTENOIC ACID, 2-METHYL-, PHENYLMETHYL ESTER, (E)-BENZENEBUTANOIC ACID, ETHYL ESTER BENZENEACETIC ACID, BUTYL ESTER BICYCLO[3.1.1]HEPT-2-ENE-2-METHANOL, 6,6-DIMETHYL-, ACETATE, (1S)-3-CYCLOHEXENE-1-PROPANAL, .BETA, 4-DIMETHYL-CYCLOHEXANONE, 2-(1-CYCLOHEXEN-1-YL)-PROPANOIC ACID, 2-METHYL-, 1-METHYL-1-PHENYLETHYL ESTER 2,4-DECADIENAL 2,4-DECADIENAL, (E,E)-BUTANOIC ACID, 2-PHENYLETHYL ESTER CYCLOPROPANECARBOXYLIC ACID, 2-PENTYL-, TRANS-2-CYCLOPENTEN-1-ONE, 3-METHYL-2-(2-PENTENYL)-, (E)-2H-PYRAN-2-ONE, 6-HEXYLTETRAHYDRO-NONANOIC ACID, 2-ACETYL-, ETHYL ESTER BENZENEACETALDEHYDE, AR-(1-METHYLETHYL)-3-HEXANONE, 5-METHYL-5-PHENYL-OXACYCLODODECAN-2-ONE BUTANOIC ACID, 2-METHYL-, 2-PHENYLETHYL ESTER 5,8-METHANO-2H-1-BENZOPYRAN, 6-ETHYLIDENEOCTAHYDRO-ETHANONE, 1-[4-(1,1-DIMETHYLETHYL)PHENYL]-BENZENEPROPANOL, PROPANOATE 1,3-DIOXOLANE, 2-(2,6-DIMETHYL-1,5-HEPTADIENY)-[1,1'-BICYCLOHEXYL]-2-ONE 1,3-BENZODIOXOLE, 5-PROPYL-PROPANOIC ACID, 2-METHYL, 3-PHENYLPROPYL ESTER ETHANONE, 1-(4,7,7-TRIMETHYLBICYCLO[4.1.0]HEPT-4-EN-3-YL)-2H-PYRAN-2-ONE, 6-(3-HEXENYL)TETRAHYDRO-, (Z)-DISULFIDE, METHYL PHENYLMETHYL ETHANONE, 1-[4-(1-METHYLETHYL)PHENYL]-BENZENEPROPANOL, .BETA, .BETA, 3-TRIMETHYL-6-OCTENOIC ACID, 3,7-DIMETHYL, (.+-.)-6-OCTENOIC ACID, 3,7-DIMETHYL-BENZENEPROPANAL, 4-ETHYL-.ALPHA.,.ALPHA.-DIMETHYL-2(3H)-FURANONE, 5-HEPTYLDIHYDRO-NONANOIC ACID PHENOL, 2-METHYL-5-(1-METHYLETHYL)-, ACETATE BENZENEMETHANOL, 4-(1-METHYLETHYL)-, ACETATE BENZENEACETALDEHYDE, 4-(1-METHYLETHYL)-PROPANOIC ACID, 2-METHYL-, 3-PHENYL-2-PROPENYL ESTER PHENOL, 5-METHYL-2-(1-METHYLETHYL)-, ACETATE BUTANOIC ACID, 2-PHENYLPROPYL ESTER ETHANONE, 1-[2-METHYL-5-(1-METHYLETHYL) PHENYL]-ACETALDEHYDE, [(3,7-DIMETHYL-6-OCTENYL)OXY]-2-FURANPROPANOIC ACID, 2-METHYLPROPYL ESTER BENZENE, (2-BUTOXYETHYL)-BUTANOIC ACID, 1-METHYL-2-PHENYLETHYL ESTER 2H-PYRAN, TETRAHYDRO-4-METHYL-2-PHENYL-BENZENE, (2-ISOTHIOCYANATOETHYL)-DECANEDIOIC ACID, DIMETHYL ESTER BUTANOIC ACID, 3-METHYL-, 2-PHENYLETHYL ESTER 1,3-BENZODIOXOLE, 5-(1-PROPENYL)-HEXANOIC ACID, 2-FURANYLMETHYL ESTER BICYCLO[3.1.1]HEPT-2-ENE-2-PROPANAL, 6,6-DIMETHYL-PHENOL, (1,1-DIMETHYLETHYL)-4-METHOXY-2H-PYRAN, 3,6-DIHYDRO-4-METHYL-2-PHENYL-PHENOL, 2-(1,1-DIMETHYLETHYL)-4-METHOXY-2,6-OCTADIENOIC ACID, 3,7-DIMETHYL-2-PROPENOIC ACID, 2-METHYL, 2-PHENYLETHYL ESTER FURAN, TETRAHYDRO-2,4-DIMETHYL-4-PHENYL-BUTANOIC ACID, 2-PHENOXYETHYL ESTER 4,7-METHANO-1H-INDEN-5-OL, OCTAHYDRO-, ACETATE UNDECANOIC ACID, HYDROXY-, LACTONE OXIRANECARBOXYLIC ACID, 2-METHYL-3-(4-METHYLPHENYL)-, ETHYL ESTER BENZENE, 1,2-BIS(2-PROPENYLOXY)-2-FURANPROPANOIC ACID, 3-METHYLBUTYL ESTER BENZOIC ACID, 2-HYDROXY-, PROPYL ESTER NAPHTHALENE, 2-METHOXY-BENZENEPROPANOL, .GAMMA-METHYLENE-, ACETATE 1,3-OCTANEDIOL, 2-METHYL-, DIACETATE 2-NONENOIC ACID 1,3-DIOXANE, 2,5,5-TRIMETHYL-2-PHENYL-4,7-METHANO-1H-INDEN-6-OL, 3A,4,5,6,7,7A-HEXAHYDRO-, PROPANOATE 2-PROPENOIC ACID, 3-PHENYL-, 1-METHYLETHYL ESTER 2-BUTENOIC ACID, 2-METHYL-, 2-PHENYLETHYL ESTER, (E)-2-BUTENOIC ACID, 2,3-DIMETHYL-, PHENYLMETHYL ESTER OCTANEDIOIC ACID, DIETHYL ESTER BENZENEPROPANAL, .ALPHA-METHYL-4-(1-METHYLETHYL)-4,7-METHANO-1H-INDEN-5-OL, 3A,4,5,6,7,7A-HEXAHYDRO-, PROPANOATE BENZENE, [2-(1-(PROPOXYETHOXY)ETHYL]-2-PROPENOIC ACID, 3-PHENYL-, PROPYL ESTER BENZENEACETALDEHYDE, .ALPHA.(2-METHYLPROPYLIDENE)-BUTANEDIOIC ACID, DIBUTYL ESTER BUTANOIC ACID, 3-PHENYL-2-PROPENYL ESTER SPIRO[1,4-METHANONAPHTHALENE-2(1H),2'-OXIRANE],3,4,4A,5,8,8A-HEXAHYDRO-3',7-DIMETHYL-BENZENE, 1-ETHOXY-2-METHOXY-4-(1-PROPENYL)-1,3-BENZODIOXOLE, 5-(2-PROPENYL)-SPIRO[1,4-METHANONAPHTHALENE-2(1H),2'-OXIRANE],3,4,4A,5,8,8A-HEXAHYDRO-3',6-DIMETHYL-1,3-DIOXANE, 4,4,6-TRIMETHYL-2-PHENYL-PHENOL, 3-(1,1-DIMETHYLETHYL)-4-METHOXY-PHENOL, 2-ETHOXY-5-(1-PROPENYL)-BENZENEBUTANOL, .BETA,.DELTA.-DIMETHYL-2-PROPENOIC ACID, 3-PHENYL-, 2-PROPENYL ESTER BENZOIC ACID, 2-HYDROXY-5-METHYL-, ETHYL ESTER 1,3-NONANEDIOL, DIACETATE [1,1'-BICYCLOHEXYL]-4-ONE BENZENEPENTANOL, .BETA-METHYL-1,3-DIOXANE, 2,4,6-TRIMETHYL-4-PHENYL-2H-PYRAN, TETRAHYDRO-2-METHYL-4-METHYLENE-6-PHENYL-QUINOLINE, 6-(IMETHYLETHYL)-2H-PYRAN, 3,6-DIHYDRO-4,6-DIMETHYL-2-PHENYL-2H-PYRAN, 3,6-DIHYDRO-2,4-DIMETHYL-6-PHENYL-BUTANOIC ACID, 3-PHENYL-2-PROPENYL ESTER, (E)-BENZENEPROPANAL, 4-(1-METHYLETHYL)-BENZENEPENTANAL, .BETA.-METHYL-1-OXASPIRO[4.5]DECAN-6-OL, 2,6,10,10-TETRAMETHYL-, CYCLOHEXANONE, 4-(1-ETHOXYETHENYL)-3,3,5,5-TETRAMETHYL-9-DECENOIC ACID BENZENEPENTANOL, .GAMMA.-METHYL-NONANEDIOIC ACID, DIETHYL ESTER BENZENEPROPANAL, 4-(1,1-DIMETHYLETHYL)-2-OCTANOL, 8,8-DIETHOXY-2,6-DIMETHYL-2-PENTENENITRILE, 3-METHYL-5-PHENYL-, (Z)-BUTANOIC ACID, 3-OXO-, 3,7-DIMETHYL-2,6-OCTADIENYL ESTER, (E)-BENZENEPROPANAL, .BETA.-METHYL,3-(1-METHYLETHYL)-BENZOIC ACID, 4-HYDROXY-, PROPYL ESTER UNDECANEDIOIC ACID, DIMETHYL ESTER 1H-INDEN-1-ONE, 2,3-DIHYDRO-2-(1-METHYLETHYL)-1,3-DIOXANE, 4,4,6-TRIMETHYL-2-(PHENYLMETHYL)-ETHANONE, 1-(5,6,7,8-TETRAHYDRO-2-NAPHTHALENYL)-BENZENEHEXANOL NONANEDIOL, DIACETATE 2-PROPENOIC ACID, 3-(4-METHOXYPHENYL)-, PROPYL ESTER 1,1'-BIPHENYL, 2-METHOXY-BENZOIC ACID, PHENYL ESTER BENZENE, 1,1'-[OXYBIS(METIHYLENE)]BIS-BENZOIC ACID, 4-HYDROXY-, BUTYL ESTER 4,7-METHANO-1H-INDENE-2-METHANOL, OCTAHYDRO-, ACETATE 4,7-METHANO-1H-INDENEMETHANOL, OCTAHYDRO-, ACETATE [1,1'-BIPHENYL]-2-OL BENZOIC ACID, 2-HYDROXY-4-METHOXY-6-METHYL-, ETHYL ESTER 1,3-BENZODIOXOLE, 4,7-DIMETHOXY-5-2-PROPENYL)-METHANONE, DIPHENYL-1(3H)ISOBENZOFURANONE, 3-BUTYLIDENE-2-FURANCARBOXYLIC ACID, 2-PHENYLETHYL ESTER BENZOIC ACID, PHENYLMETHYL ESTER CYCLOPENTANECARBOXYLIC ACID, 2-HEXYL-3-OXO-, METHYL ESTER FURAN, 2,2'-[DITHIOBIS(METHYLENE)]BIS-BENZENEMETHANAMINE, N-(PHENYLMETHYL)-PYRIDINE, 2-(2-PHENYLETHYL)-2-PROPANONE, 1,3-DIPHENYL-2H-PYRAN, TETRAHYDRO-2-[2-METHOXY-4-(2-PROPENYL)PHENOXY]-BENZENEACETIC ACID, 2-METHOXYPHENYL ESTER 2-CYCLOHEXENE-1-CARBOXYLIC ACID, 2-METHYL-4-OXO-6-PENTYL-, ETHYL ESTER 2-PROPEN-1-ONE, 1,3-DIPHENYL-METHANONE, (2-HYDROXY-4-METHOXYPHENYL)PHENYL-DODECANEDIOIC ACID TRIDECANEDIOIC ACID PIPERIDINE, 1-[5-(1,3-BENZODIOXOL-5-YL-1-OXO-2,4-PENTADIENYL]-,(E,E)-

Optionally, the fabric substantive perfuime ingredients may be selected from the group consisting of: allyl cyclohexane propionate, ambrettolide, amyl benzoate, amyl cinnamate, amyl cinnamic aldehyde, amyl cinnamic aldehyde dimethyl acetal, iso-amyl salicylate, aurantiol (trade name for hydroxycitronellal-methyl anthranilate), benzophenone, benzyl salicylate, iso-butyl quinoline, beta-caryophyllene, cadinene, cedrol, cedryl acetate, cedryl formate, cinnamyl cinnamate, cyclohexyl salicylate, cyclamen aldehyde, dihydro isojasmonate, diphenyl methane, diphenyl oxide, dodecalactone, iso E super (trade name for 1-(1,2,3,4,5,6,7,8-octahydro-2,3,8,8-tetramethyl-2-naphthalenyl)-ethanone), ethylene brassylate, ethyl methyl phenyl glycidate, ethyl undecylenate, iso-eugenol, exaltolide (trade name for 15-hydroxypentadecanoic acid, lactone), galaxolide (trade name for 1,3,4,6,7,8-hexahydro-4,6,6,7,8,8-hexamethylcyclopenta-gamma-2-benzopyran), geranyl anthranilate, hexadecanolide, hexenyl salicylate, hexyl cinnamic aldehyde, hexyl salicylate, lilial (trade name for para-tertiary-butyl-alpha-methyl hydrocinnamic aldehyde), linalyl benzoate, 2-methoxy naphthalene, methyl cinnamate, methyl dihydrojasmonate, beta-methyl naphthyl ketone, musk indanone, musk ketone, musk tibetine, myristicin, delta-nonalactone, oxahexadecanolide-10, oxahexadecanolide-11, patchouli alcohol, phantolide (trade name for 5-acetyl-1,1,2,3,3,6-hexamethylindan), phenyl ethyl benzoate, phenylethylphenylacetate, phenyl heptanol, phenyl hexanol, alpha-santalol, thibetolide (trade name for 15-hydroxypentadecanoic acid, lactone), tonalid, delta-undecalactone, gamma-undecalactone, vetiveryl acetate, yara-yara, allyl phenoxy acetate, cinnamic alcohol, cinnamic aldehyde, cinnamyl formate, coumarin, dimethyl benzyl carbinyl acetate, ethyl cinnamate, ethyl vanillin (3-methoxy-4-ethoxy benzaldehyde), eugenol, eugenyl acetate, heliotropine, indol, isoeugenol, koavone, methyl-beta-naphthyl ketone, methyl cinnamate, methyl dihdrojasmonate, beta methyl naphthyl ketone, methyl-n-methyl anthranilate, delta-nonalactone, gamma-nonalactone, para methoxy acetophenone (acetanisole), phenoxy ethyl iso butyrate, phenoxy ethyl propionate, piperonal, triethyl citrate, vanillin, and mixtures thereof.

Other fabric substantive perfume ingredients useful in the present invention include methyl-N-methyl anthranilate, benzyl butyrate, benzyl iso valerate, citronellyl isobutyrate, citronellyl propionate, delta-nonalactone, dimethyl benzyl carbinyl acetate, dodecanal, geranyl acetate, geranyl isobutyrate, gamma-ionone, para-isopropyl phenylacetaldehyde, cisjasmone, methyl eugenol, hydroxycitronellal, phenoxy ethanol, benzyl iso valerate, anisic aldehyde, cuminic alcohol, methyl eugenol, and mixtures thereof.

Fabric substantive perfume ingredients useful herein include any pro-fragrance or pro-perfume ingredient having the physical properties identified above, or any adduct or complex of more volatile perfumery materials with polymers or other fabric-substantive molecules. Specifically included are adducts or complexes of ketones including cis-jasmone, dihydrojasmone, a-ionone, b-ionone, dihydro-b-ionone, g-methyl ionone, a-iso-methyl ionone, 4-(3,4-methylenedioxyphenyl)butan-2-one, 4-(4-hydroxyphenyl) butan-2-one, methyl b-naphthyl ketone, methyl cedryl ketone, 6-acetyl-1,1,2,4,4,7-hexamethyltetralin (tonalid), l-carvone, 5-cyclohexadecen-1-one, alpha-damascone, beta-darascone, delta-damascone, beta-amascenone, muscone, 6,7-dihydro-1,1,2,3,3-pentamethyl-4(5H)-indanone (cashmeran), acetophenone, decatone, 2-[2-(4-methyl-3-cyclohexenyl-1-yl)propyl]cyclopentan-2-one, 2-sec-butylcyclohexanone, bdihydro ionone, allyl ionone, a-irone, a-cetone, a-irisone, acetanisole, geranyl acetone, 1-(2-methyl-5-isopropyl-2-cyclohexenyl)-1-propanone, acetyl diisoamylene, methyl cyclocitrone, 4-t-pentyl cyclohexanone, p-t-butylcyclohexanone, o-t-butylcyclohexanone, ethyl amyl ketone, ethyl pentyl ketone, menthone, methyl-7,3-dihydro-2H-1,5-benzodioxepine-3-one, fenchone.

(g) Scavenger agent—The compositions of the present invention may comprise at least about 0.001%, preferably from about 0.5% to about 10%, most preferably to about 5% by weight, of one or more scavenger agents. Scavenger agents suitable for use herein are selected from scavengers selected to capture fugitive dyes and/or anionic surfactants and/or soils.

Preferred scavenger agents are selected from the group consisting of fixing agents for anionic dyes, complexing agents for anionic surfactants, clay soil control agents and mixtures thereof. These materials can be combined at any suitable ratio. Suitable compounds are included in commonly patents to Gosselink et al and are commercially available from BASF, Ciba and others.

i) Fixing Agents for Anionic dyes—Dye fixing agents, "fixatives", or "fixing agents" are well-known, commercially available materials which are designed to improve the appearance of dyed fabrics by minimizing the loss of dye from fabrics due to washing. Not included within this definition are components which can in some embodiments serve as fabric softener actives.

Many fixing agents for anionic dyes are cationic, and are based on quatemized nitrogen compounds or on nitrogen compounds having a strong cationic charge which is formed in situ under the conditions of usage.

Fixing agents are available under various trade names from several suppliers. Representative examples include: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneimine-based) ex Sandoz; SANDOFIX TPS, ex Sandoz, is a preferred dye fixative for use herein. Additional non-limiting examples include SANDOFIX SWE (a cationic resinous compound) ex Sandoz, REWIN SRF, REWIN SRF-O and REWIN DWR ex CHT-Beitlich GMBH; Tinofix® ECO, Tinofix® FRD and Solfin® ex Ciba-Geigy and described in WO 99/14301. Other preferred fixing agents for use in the compositions of the present invention are CARTAFIX CB® ex Clariant and the cyclic amine based polymers, oligomers or copolymers described in WO 99/14300.

Other fixing agents useful herein are described in "After-treatments for Improving the Fastness of Dyes on Textile Fibres", Christopher C. Cook, *Rev. Prog. Coloration*, Vol. XII, (1982). Dye fixing agents suitable for use in the present invention are ammonium compounds such as fatty acid-damine condensates, inter alia the hydrochloride, acetate, methosulphate and benzyl hydrochloride salts of diamine esters. Non-liniting examples include oleyldiethyl aminoethylamide, oleylmethyl diethylenediamine methosulphate, and monostearylethylene diaminotrimethylammonium methosulphate. In addition, N-oxides other than surfactant-active N-oxides, more particularly polymeric N-oxides such as polyvinylpyridine N-oxide, are useful as fixing agents herein. Other useful fixing agents include derivatives of polymeric alkyldiamines, polyamine-cyanuric chloride condensates, and aminated glycerol dichlorohydrins.

Fixing agents for anionic dyes can be used in the present methods either in the form of such agents fully integrated into the inventive compositions, or by including them in a laundry treatment method according to the invention in the form of a separate article, for example a substrate article or sheet, which can be added to the wash along with the cationic silicone containing composition. In this manner, the fixing agent can complement the use of the cationic silicone composition. Combinations of such dye fixing articles and compositions comprising the cationic silicones can be sold together in the form of a kit.

ii) Scavenger agents for anionic surfactants and/or soils—Suitable scavenger agents for anionic surfactants and/or soils include alkoxylated polyalkyleneinines and/or quaternized derivatives thereof.

(h) Fabric softeners—Fabric softeners, when present in the preferred compositions of the invention, are suitably at levels of up to about 30% by weight of the composition, more typically from about 1% to about 20%, preferably from about 2% to about 10% in certain embodiments. Suitable fabric softeners for use in the present invention include all the current commercial quaternary long-chain softeners, especially at least partially unsaturated esterquats with varying iodine value. Suitable fabric softeners more generally include fabric softening compounds which are cationic, water insoluble quaternary ammonium compounds comprising a polar head group and two long hydrocarbyl moieties, preferably selected from alkyl, alkenyl and mixtures thereof, wherein each such hydrocarbyl moiety has an average chain length equal to or greater than $C_{12}$, preferably greater than $C_{14}$, more preferably greater than $C_{16}$, More preferably still, at least 50% of each long chain alkyl or alkenyl group is predominantly linear. A preferred overall chain length is about $C_{18}$, though mixtures of chainlengths having non-zero proportions of lower, e.g., $C_{14}$, $C_{16}$ and some higher, e.g., $C_{20}$ chains can be quite desirable. The cationic softener can suitably be distearyl dimethyl ammonium chloride or unsaturated analogs thereof, but more preferably for the environment, the quaternary ammonium fabric softener is selected to be biodegradable. This property is present, for example, in the common commercial esterquat fabric softeners such as di(tallowyloxyethyl)dimethyl ammonium chloride.

In one preferred embodiment, the fabric softening compound is a quaternary ammonium esterquat compound having two $C_{12-22}$ alkyl or alkenyl groups connected to a quaternary ammonium moiety via at least one ester moiety, preferably two such ester moieties. A preferred esterquat ammonium fabric softener for use in the present compositions has the formula:

$\{(R^1)_2N((CH_2)_nER^2)_2\}^+X^-$ wherein each $R^1$ group is independently selected from $C_{1-4}$ alkyl, hydroxyalkyl or $C_{2-4}$ alkenyl; and wherein each $R^2$ is independently selected from $C_{8-28}$ alkyl or alkenyl groups; E is an ester moiety i.e., —OC(O)— or —C(O)O—, n is an integer from 0-5, and $X^-$ is a suitable anion, for example chloride, methosulfate and mixtures thereof.

A second preferred type of quaternary ammonium material can be represented by the formula: $\{(R^1)_3N(CH_2)_nCH(O(O)CR^2)CH_2O(O)CR^2\}^+X^-$ wherein each $R^1$ group is independently selected from $C_{1-4}$ alkyl, hydroxyalkyl or $C_{2-4}$ alkenyl; each $R^2$ is independently selected from $C_{8-28}$ alkyl or alkenyl groups; n is an integer from 0-5; and $X^-$ is a suitable anion, for example chloride, methosulfate and mixtures thereof. This latter class can be exemplified by 1,2 bis[hardened tallowoyloxy]-3-trimethylammonium propane chloride.

Esterquat fabric softeners as available in commerce include materials comprising varying proportions of monoester in addition to diester.

Suitable fabric softeners herein include softening compounds having a solubility less than $1\times10^{-3}$ wt %, more preferably less than $1\times10^{-4}$ wt %, more preferably still, from $1\times10^{-6}$ wt % to $1\times10^{-8}$ wt %, in demineralised water at 20 degrees C.

(i) Detersive enzyme—Suitable detersive enzymes for use herein include protease, amylase, cellulase, mannanase, endoglucanase, lipase and mixtures thereof. Enzymes can be used at their art-taught levels, for example at levels recommended by suppliers such as Novo and Genencor. Typical levels in the compositions are from about 0% to about 5%. When enzymes are present, they can be used at very low levels, e.g., from about 0.001% or lower, in certain embodiments of the invention; or they can be used in heavier-duty laundry detergent formulations in accordance with the invention at higher levels, e.g., about 0.1% and higher. In accordance with a preference of some consumers for "non-biological" detergents, the present invention includes both enzyme-containing and enzyme-free embodiments.

(j) Chelant—Suitable chelants for use herein include nitrogen-containing, P-free aminocarboxylates such as EDDS, EDTA and DTPA; aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelants such as compounds of the general class of certain macrocyclic N-ligands such as those known for use in bleach catalyst systems. Levels of cheland are typically lower than about 5%, more typically, chelants, when present, are at levels of from about 0.01% to about 3%.

(k) Solvent system—The solvent system in the present compositions can be anhydrous or hydrous; and can include water alone or mixtures of organic solvents with water. Preferred organic solvents include 1,2-propanediol, ethanol, glycerol and mixtures thereof Other lower alcohols, $C_1$-$C_4$ alkanolamines such as monoethanolamine and triethanolamine, can also be used. Solvent systems can be absent, for example from anhydrous solid embodiments of the invention, but more typically are present at levels in the range of from about 0.1% to about 98%, preferably at least about 10% to about 95%, more usually from about 25% to about 75%.

(l) Effervescent system—Effervescent systems suitable herein include those derived by combining an acid and a bicarbonate or carbonate, or by combining hydrogen peroxide and catalase, or any other combination of materials which release small bubbles of gas. The components of the effervescent system may be combinedly dispensable to form the effervescence when they are mixed, or can be formulated together provided that conventional coatings or protection systems are used. Levels of effervescent system can vary very widely, for example effervescent components together can range from about 0.1% to about 30% of the composition. Hydrogen peroxide and catalase are very mass efficient and can be at much lower levels with excellent results.

(m) Coating or encapsulating agent—Any suitable coatings or encapsulating agents can be applied to all or a part of the present compositions. Suitable examples include polyvinylalcohol film or other suitable variations; carboxymethylcellulose, cellulose derivatives, starch, modified starch, sugars, PEG, waxes, or combinations thereof. Coatings can have one or a plurality of layers. The amount of coating material, for any material coated, can range from about 5% to about 50% by weight of the material to be coated or encapsulated.

(n) Mixtures of adjuncts—Mixtures of the above components can be made in any proportion.

(o) Other adjuncts—Examples of other suitable cleaning adjunct materials include, but are not limited to, fatty acids, alkoxylated benzoic acids or salts thereof such as trimethoxy benzoic acid or a salt thereof (TMBA), conventional (not fabric substantive) perfumes and pro-perfumes, anionic surfactants, including but not limited to linear alkylbenzene sulfonates, alkyl sulfates, alkyl ethoxysulfates and mixtures thereof, including also linear and branched (including mid-chain branched forms) of such surfactants, zwitterionic and/or amphoteric surfactants, bleaches, bleach activators, bleach catalysts, enzyme stabilizing systems, optical brighteners or fluorescers, soil release polymers, dispersants or polymeric organic builders including water-soluble polyacrylates, acrylate/maleate copolymers and the like , suds suppressors, dyes, colorants, filler salts such as sodium sulfate, hydrotropes such as toluenesulfonates, cumene-sulfonates and naphthalenesulfonates, photoactivators, hydrolyzable surfactants, preservatives, anti-oxidants, anti-shrinkage agents, anti-wrinkle agents, germicides, fungicides, color speckles, colored beads, spheres or extrudates, sunscreens, fluorinated compounds, clays, pearlescent agents, luminescent agents or chemiluminescent agents, anti-corrosion and/or appliance protectant agents, alkalinity sources or other pH adjusting agents, solubilizing agents, carriers, processing aids, pigments, free radical scavengers, and pH control agents. Suitable materials include those described in U.S. Pat. Nos. 5,705,464, 5,710,115, 5,698,504, 5,695,679, 5,686,014 and 5,646,101.

Incorporation of Cationic Silicones into Compositions of the Invention

Incorporation of cationic silicones into compositions of the invention can be done in any suitable manner and can, in general, involve any order of mixing or addition. However, it has been discovered that there exist certain preferred ways to accomplish such incorporation.

A first method involves introducing the cationic silicone polymer as received from the manufacturer directly into a preformed mixture of two or more of the other components of the final composition. This can be done at any point in the process of preparing the final composition, including at the very end of the formulating process.

A second method involves premixing the cationic silicone polymer with one or more adjuncts of the final composition and adding this premix to a mixture of the remaining adjuncts.

A preferred method more specifically has a step of mixing the cationic silicone polymer with an adjunct selected from the group consisting of cationic surfactants, cationic fabric softeners, amine surfactants, amine oxide surfactants, alkoxylated alcohols, fabric substantive perfume ingredients, and mixtures thereof, more preferably in the presence of a portion of the overall organic solvents to be used, followed by a step of combining the resulting cationic silicone polymer premix with one or more other adjuncts of the composition, water and the balance of the organic solvents, thereby forming the final composition.

These methods of introducing the cationic silicone polymer into the final composition are preferably assisted by use of conventional high-shear mixing means. This ensures proper dispersion of the cationic silicone polymer throughout the final composition.

Liquid compositions, especially liquid detergent compositions in accordance with the invention preferably comprise a stabilizer, especially preferred being trihydroxystearin or hydrogenated castor oil, for example the type commercially available as Thixcin®. When a stabilizer is to be added to the present compositions, it is preferably introduced as a separate stabilizer premix with one or more of the adjuncts, or non-silicone components, of the composition. When such a stabilizer premix is used, it is preferably added into the composition after the cationic silicone polymer has already been introduced and dispersed in the composition.

EXAMPLES

The following nonlimiting examples are illustrative of the present invention. Percentages are by weight unless otherwise specified.

Example 1

Liquid fabric care compositions A-D according to the present invention are prepared as follows:

| | A (Wt %) | B (Wt %) | C (Wt %) | D (Wt %) |
|---|---|---|---|---|
| $C_{13-15}$ EO7 ethoxylated surfactant | 20 | 20 | 0 | 0 |
| $C_{12-14}$ amineoxide surfactant | 5 | 5 | 0 | 0 |
| HLAS | 0 | 0 | 20 | 20 |
| Citric acid | 6 | 6 | 0 | 0 |
| $C_{12-18}$ fatty acid | 0 | 0 | 15 | 15 |
| Diethylene triamine pentamethylene phosphonic acid | 0.4 | 0.4 | 0 | 0 |
| Hydroxyethanedimethylene-phosphonic acid | 0.45 | 0.45 | 0 | 0 |
| Ethoxylated polyethyleneimine, m.w. 1600 | 2.65 | 2.65 | 0 | 0 |
| Boric acid | 2 | 2 | 0 | 0 |
| $CaCl_2$ | 0.02 | 0.02 | 0.02 | 0.02 |
| Propanediol | 18 | 18 | 20 | 20 |
| Ethanol | 1 | 1 | 0 | 0 |
| Monoethanolamine | to pH 8.5 | to pH 8.5 | 0 | 0 |
| NaOH | 0 | 0 | to pH 8.5 | to pH 8.5 |
| Protease enzyme | 0.77 | 0.77 | 0 | 0 |
| Amylase enzyme | 0.06 | 0.06 | 0.06 | 0.06 |
| Cellulase enzymes | 0.16 | 0.16 | 0.16 | 0.16 |
| Cationic Silicone Polymer* | 1.0 | 1.0 | 2.5 | 2.5 |
| Cationic Fabric Softener** | 0 | 2 | 0 | 0 |
| Fixing Agent For Anionic Dyes*** | 0 | 0 | 0 | 1 |
| Water | to 100 parts | to 100 parts | to 100 parts | to 100 parts |

*Structure 2, $R^1$ = methyl, $R^2 = (CH_2)_3$, X = $CH_2CHOHCH_2$, cationic divalent moiety ii(a) with $R^4$, $R^5$, $R^6$, $R^7$ all methyl and $Z^1$ is $(CH_2)_6$. A = 50% acetate, 50% laurate, weight basis; polyalkyleneoxide moiety(iii) of Structure 2 is $NHCH(CH_3)CH_2O(C_2H_4O)_{38}(C_3H_6O)_6CH_2CH(CH_3)NH$; cationic monovalent moiety iv(a) of Structure 2 has $R^{12}$, $R^{13}$ and $R^{14}$ all methyl; a = 0; b = 1; c = 150; d = 0; m = 2.
**REWOQUAT V3620 (diester ammonium quat) from Goldschmidt
***CARTAFIX CB from Clariant.

Either of these compositions is used in the home to launder bundles of garments, with excellent cleaning and fabric care results.

Example 2

Granular fabric care compositions A and B according to the present invention are prepared as follows:

| | A | B |
|---|---|---|
| Builders | | |
| Zeolite | 21.53 | 21.53 |
| Sodium Carbonate (total) | 33.12 | 33.12 |
| SKS6 Layered Silicate (Clariant) | 4.50 | 4.50 |
| Silicate (2 ratio) | 0.12 | 0.12 |
| Polymer | | |
| Acrylic acid/maleic acid copolymer | 2.43 | 2.43 |
| Na carboxymethylcellulose | 0.15 | 0.15 |
| Surfactants | | |
| LAS | 9.95 | 9.95 |
| Cationic Surfactant ($C_{12}$-$C_{14}$ dimethylhydroxyethylammonium chloride) | 1.99 | 1.99 |
| Bleach/Chelant System | | |
| Na perborate tetrahydrate | 9.0 | 9.0 |
| Tetraacetylethylenediamine | 1.63 | 1.63 |

-continued

| | A | B |
|---|---|---|
| Hydroxyethylidenediphosphonic acid (60%) | 0.21 | 0.21 |
| $MgSO_4$ | 0.41 | 0.41 |
| S,S'-ethylenediaminedisuccinic acid | 0.18 | 0.18 |
| Enzymes | | |
| Savinase (13 KNPU) | 0.45 | 0.45 |
| Termamyl (130 KNU/g) | 0.14 | 0.14 |
| Carezyme (1000s CEVU/g) | 0.19 | 0.19 |
| Sud Suppressors | | |
| Silicone Suds Suppressor | 1.17 | 1.17 |
| Aesthetics/Misc. | | |
| Sodium Toluene Sulfonate | 1.0 | 1.0 |
| Soap | 0.75 | 0.75 |
| Sodium Sulphate | 22.24 | 22.24 |
| — | | |
| Cationic Silicone Polymer* | 6.75 | 2.75 |
| Fabric Substantive Perfume | 0.2 | 0.5 |

*Structure 1; $R^1$ = methyl; $R^2$ = $(CH_2)_3$; X = $CH_2CHOHCH_2$; Z = $N^+(CH_3)_2C_{12-14}$; A = acetate; a = 0; b = 1; c = 82; d = 0; n = 2

Either of these compositions is used in the home to launder bundles of garments, with excellent cleaning and fabric care results.

Example 3

A liquid fabric care composition in accordance with the present invention is prepared as follows:

| | A (Wt %) |
|---|---|
| Neodol 23-5 | 15 |
| $C_{12-14}$ amineoxide surfactant | 5 |
| Neodol 35-7 | 2 |
| Citric acid | 6 |
| Diethylene triamine penta methylenephosphonic acid | 0.4 |
| Hydroxyethanedimethylenephosphonic acid | 0.45 |
| Ethoxylated polyethylene imine | 1 |
| Ethoxylated hexamethylene diamine quat. | 2 |
| Boric acid | 2 |
| $CaCl_2$ | 0.02 |
| Propanediol | 23 |
| Ethanol | 0.58 |
| Monoethanolamine | to pH 8 |
| Protease enzyme | 0.74 |
| Amylase enzyme | 0.223 |
| Cellulase enzyme | 0.014 |
| Mannanase enzyme | 0.28 |
| Thixcin ® | 1 |
| Suds Suppressor | 0.095 |
| Dispersant | 0.019 |
| Aerosil R812/nonionic | 0.086 |
| Fabric substantive perfume | 0.6 |
| Cationic Silicone Polymer* | 1.5 |
| Water | to 100 parts |

*As in Example 1

The composition is used in the home to launder bundles of garments, with excellent cleaning and fabric care results.

Example 4

Dual-part compositions in accordance with the present invention are prepared and added to a dual-compartment container. In use, the compartment A composition and the compartment B composition are in each case simultaneously poured from the container into a measuring cup, generating effervescence upon mixing. In these examples, the compartment A composition and the compartment B composition are thus separate but combinedly dispensable. In an alternate separate but combinedly dispensable execution, the compartment A composition and the compartment B composition are stored in a dual compartment container designed to deliver a 4:1 weight ratio of the compartment A composition, vs the compartment B composition and A and B are dispensed from a dispenser tap positioned toward the bottom of the dual compartment package which is gravity fed and does not require pouring from the top. The composition resulting from mixing A and B in each case (Examples 4a and 4b) are used to launder domestic fabrics with excellent cleaning and fabric care results.

| | Example 4a % wt. | Example 4b % wt. |
|---|---|---|
| COMPARTMENT A COMPOSITION | | |
| Cationic silicone as in Example 1 | 1 | 3 |
| C12-15 Alkyl alcohol 5 ethoxylated | 20 | 20 |
| C12 Alkyl Dimethylamine amine oxide | 5 | 5 |
| Sodium bicarbonate | 3 | 3 |
| Propylene glycol | 5 | 5 |
| Cumene sulfonic acid | 5 | 5 |
| Monoethanolamine | 2.9 (to pH 8.5) | 2.9 (to pH 8.5) |
| Boosters, enzymes, perfume | 5 | 5 |
| COMPARTMENT B COMPOSITION | | |
| Phthaloylimidoperoxycaproic acid | 0 | 17 |
| Citric acid | 30 | 30 |
| Sodium hydroxide | 7.3 (to pH 3.0) | 7.3 (to pH 3.0) |

Example 5

A detergent foam suitable for washing fine fabrics in according with the present invention is prepared by mixing two aqueous liquid compositions, the compartment A composition and the compartment B composition shown below, which are contained in a dual compartment bottle. The two liquids form a foam upon mixing in a dosing device or directly on the fabrics.

| | Compartment A composition-weight % | Compartment B composition-weight % |
|---|---|---|
| C12-15 alkyl 7-ethoxylate | 12 | 15 |
| C12 alkyldimethylamine N-oxide | 3.5 | 0 |
| Methyl-N-(2-hydroxyethyl)-N,N-di (tallowacyloxyethyl) ammonium methosulfate | 7 | 0 |
| Cationic silicone polymer as in Example 1 | 0.75 | 1.5 |
| Sodium citrate | 0 | 1.7 |
| Hydrogen peroxide | 4.0 | 0 |
| Catalase | 0 | 0.2 |
| Ethanol | 8 | 4 |
| Propandiol | 4 | 4 |
| Boosters, minors, perfume | 1.0 | 2.5 |
| Water | Balance | Balance |
| PH | 3.0 | 8.0 |

Example 6

Heavy duty liquid detergents in accordance with the present invention are prepared as follows:

| Ingredient | (Wt %) | (Wt %) |
|---|---|---|
| Neodol 45-7 | 15-17 | 12-14 |
| Neodol 25-3 | 0-1 | 0-1 |
| $C_{12-14}$ amineoxide surfactant | 4-5 | 3-4 |
| C8-10 amido propyl dimethylamine | 0-1 | 0-1 |
| Citric acid | 5 | 4 |
| Diethylene triamine penta methylene phosphonic acid | 0.3-0.6 | 0.2-0.5 |
| Hydroxyethanedimethylene-phosphonic acid | 0.2-0.5 | 0.2-0.4 |
| Ethoxylated polyethylene imine | 1 | 0.8-1 |
| Ethoxylated hexamethylene diamine quat. | 2 | 1.6 |
| Boric acid | 2.0-3.0 | 1.5-2.5 |
| $CaCl_2$ | 0.02 | 0.02 |
| Propanediol | 8.0-9.5 | 6.0-8.0 |
| Ethanol | 0-1 | 0-1 |
| 1,4 Cyclo Hexane Di Methanol | 0-2 | 0-2 |
| Monoethanolamine | to pH 8 | to pH 8 |
| Protease enzyme | 0.74 | 0.59 |
| Amylase enzyme | 0.223 | 0.178 |
| Cellulase enzyme | 0.014 | 0.011 |
| Mannanase enzyme | 0.05-0.28 | 0.04-0.22 |
| Thixcin ® (Hydrogenated castor oil) | 0.5-1.0 | 0.5-1.0 |
| Silicone Suds Suppressor | 0-0.1 | 0-0.1 |
| Silicone dispersant for suds suppressor | 0-0.02 | 0-0.02 |
| Dispersed silica/nonionic | 0-0.09 | 0-0.09 |
| Fabric substantive perfume | 0.5-0.8 | 0.4-0.7 |
| Cationic Silicone Polymer as in Example 1 | 1.0-1.5 | 1.0-1.5 |
| Dye | 0.001 | 0.001 |
| Water | to 100 parts | to 100 parts |

Water Absorbency and/or Wear Comfort Advantages

Unexpectedly, the present compositions have been found to deliver additional fabric care benefits, in the area of superior wear comfort and/or water absorbency, in particular as compared to conventional fabric softeners based on ditallowdimethylammonium chloride. The absorbency herein is equal to that of the most recently developed clear liquid fabric softeners.

Product with Instructions for Use

The compositions of the present invention are preferably included in a product. The product preferably comprises a fabric care composition in accordance with the present invention, and further comprises instructions for using the product to launder fabrics by contacting a fabric in need of treatment with an effective amount of the composition such that the composition imparts one or more desired fabric care benefits to the fabric.

The present invention therefore also encompasses the inclusion of instructions on the use of the fabric care compositions of the present invention with packages containing the compositions herein or with other forms of advertising associated with the sale or use of the compositions. The instructions may be included in any manner typically used by consumer product manufacturing or supply companies. Examples include providing instructions on a label attached to the container holding the composition; on a sheet either attached to the container or accompanying it when purchased; or in advertisements, demonstrations, and/or other written or oral instructions which may be connected to the purchase or use of the compositions.

Specifically the instructions will include a description of the use of the composition, for instance, the recommended amount of composition to use in a washing machine to clean the fabric; the recommended amount of composition to apply to the fabric; if soaking or rubbing is appropriate.

Service Business Use

Any of the above systems, compositions and methods can be used in a laundry service business, for example in a dry-cleaning establishment, an institutional laundry (such as school, hotel or military field laundry) or similar, without departing from the spirit and scope of the invention.

While particular embodiments of the subject invention have been described, it will be obvious to those skilled in the art that various changes and modifications of the subject invention can be made without departing from the spirit and scope of the invention. It is intended to cover, in the appended claims, all such modifications that are within the scope of the invention.

What is claimed is:

1. A thickened built aqueous liquid laundry detergent composition comprising:

(a) from 0.01% to 5% of a water-immiscible cationic silicone random block copolymer comprising three or more polydimethylsiloxane units $—[(CH_3)_2SiO]_n—$ having a degree of polymerization, n, of from 50 to 200 and organosilicon-free units comprising at least one diquaternary unit;

(b) from 0.001% to 10% of a stabilizer selected from gums and hydroxyl-containing stabilizing agents;

(c) from 5% to 50% of a surfactant;

(d) from 0.5% to 50% of builder;

(e) from 0.5% to 30% of solvent other than water; and (f) from 5% to 90% of water.

2. A liquid laundry detergent composition according to claim 1 wherein the cationic silicone polymer has the formula:

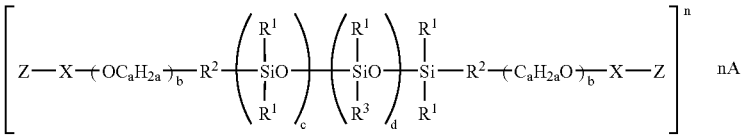

wherein:

$R^1$ is independently selected from the group consisting of: $C_{1-22}$ alkyl, $C_{2-22}$ alkenyl, $C_{6-22}$ alkylaryl, aryl, cycloalkyl and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is H, $C_{1-22}$ alkyl, $C_{2-22}$ alkenyl, $C_{6-22}$ alkylaryl, aryl; cycloalkyl, $C_{1-22}$ hydroxyalkyl, polyalkyleneoxide or (poly)alkoxy alkyl;

Z is independently selected from the group consisting of monovalent organic moieties comprising at least one quaternized nitrogen atom;

a is from 2-4;

b is from 0-100;

c is from 1-1000, preferably greater than 20, more preferably greater than 30, even more preferably greater than 50, preferably less than 500, more preferably less than 300, even more preferably less than 200, most preferably from about 70 to about 100;

d is from 0-100;

n is the number of positive charges associated with the cationic silicone polymer, which is greater than or equal to 2; and A is a monovalent anion.

3. A liquid laundry detergent composition according to claim 2 wherein Z is independently selected from the group consisting of:

(i)

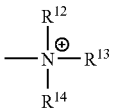

(ii)

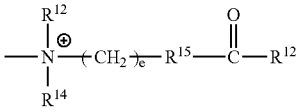

(iii)

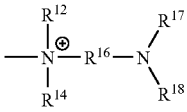

(iv)

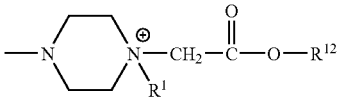

(v) monovalent aromatic or aliphatic hererocyclic group, substituted or unsubstituted, containing at least one quaternized nitrogen atom;

wherein:

$R^{12}$, $R^{13}$, $R^{14}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl, and mixtures thereof;

$R^{15}$ is —O— or $NR^{19}$;

$R^{16}$ is a divalent hydrocarbon residue;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl and mixtures thereof; and e is from 1 to 6.

4. A liquid laundry detergent composition according to claim 1 wherein the cationic silicone polymer is composed of alternating units of:

(i) a polysiloxane of the following formula:

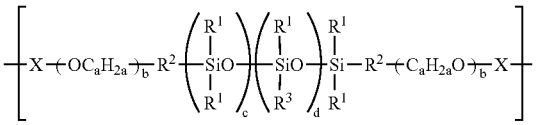

; and (ii) a divalent organic moiety comprising at least two quaternized nitrogen atoms;

wherein:

$R^1$ is independently selected from the group consisting of: $C_{1-22}$ alkyl, $C_{2-22}$ alkenyl, $C_{6-22}$ alkylaryl, aryl, cycloalkyl and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide or (poly)alkoxy alkyl;

a is from 2-4;

b is from 0-100;

c is from 1-1000, preferably greater than 20, more preferably greater than 30, even more preferably greater than 50, preferably less than 500, more preferably less than 300, even more preferably less than 200, most preferably from about 70 to about 100; and d is from 0-100.

5. A liquid laundry detergent composition according to claim 1 wherein the cationic silicone polymer is composed of alternating units of:

(i) a polysiloxane of the following formula:

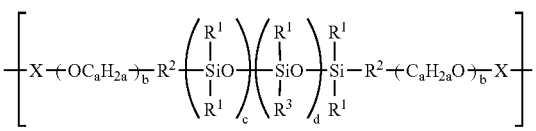

; and (ii) a cationic divalent organic moiety selected from the group consisting of:

(a)

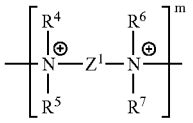

2mA;

(b)

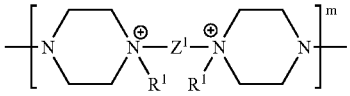

2mA;

(c)

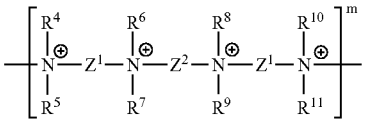

4mA;

(d) a divalent aromatic or aliphatic heterocyclic group, substituted or unsubstituted, containing at least one quaternized nitrogen atom; and (iii) optionally, a polyalkyleneoxide of formula:

$$[Y—O—(C_aH_{2a}O)_b—Y];\quad \text{and}$$

(iv) optionally, a cationic monovalent organic moiety, to be used as an end-group, selected from the group consisting of:

(i)

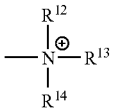

(ii)

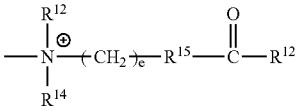

(iii)

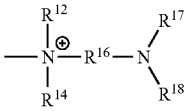

-continued (iv)

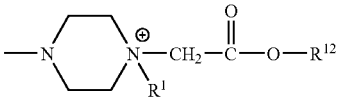

(v) monovalent aromatic or aliphatic heterocyclic group, substituted or unsubstituted, containing at least one quaternized nitrogen atom;

wherein:

$R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl and mixtures thereof; or in which $R^4$ and $R^6$, or $R^5$ and $R^7$, or $R^8$ and $R^{10}$, or $R^9$ and $R^{11}$ may be components of a bridging alkylene group;

$R^{12}$, $R^{13}$, $R^{14}$ are the same or different, and are selected from the group consisting of: $C_{1-22}$ alkyl; $C_{2-22}$ alkenyl; $C_{6-22}$ alkylaryl; $C_{1-22}$ hydroxyalkyl; polyalkyleneoxide; (poly)alkoxy alkyl groups and mixtures thereof; and $R^{15}$ is —O— or $NR^{19}$;

$R^{16}$ and $M^1$ are the same or different divalent hydrocarbon residues;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl, and mixtures thereof; and $Z^1$ and $Z^2$ are the same or different divalent hydrocarbon groups with at least 2 carbon atoms, optionally containing a hydroxy group, and which may be interrupted by one or several ether, ester or amine groups;

Y is a secondary or tertiary amine;

e is from 1-6;

m is the number of positive charges associated with the cationic divalent organic moiety, which is greater than or equal to 2; and A is an anion.

6. A liquid laundry detergent composition according to claim 1 wherein the cationic silicone polymer has the formula:

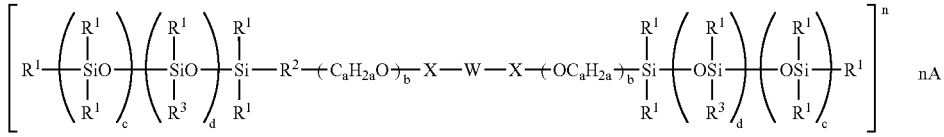

nA wherein:

$R^1$ is independently selected from the group consisting of: $C_{1-22}$ alkyl; $C_{2-22}$ alkenyl; $C_{6-22}$ alkylaryl; aryl; cycloalkyl and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide or (poly)alkoxy alkyl;

X is independently selected from the group consisting of ring-opened epoxides;

W is independently selected from the group consisting of divalent organic moieties comprising at least one quaternized nitrogen atom a is from 2-4;

b is from 0-100;

c is from 1-1000, preferably greater than 20, more preferably greater than 30, even more preferably greater than 50, preferably less than 500, more preferably less than 300, even more preferably less than 200, most preferably from about 70 to about 100;

d is from 0-100;

n is the number of positive charges associated with the cationic silicone polymer, which is greater than or equal to 1; and A is a monovalent anion, in other words, a suitable couterion.

7. A liquid laundry detergent composition according to claim 6 wherein W is selected from the group consisting of:

(a)

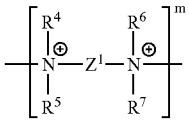

2mA;

(b)

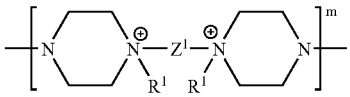

2mA;

-continued (c)

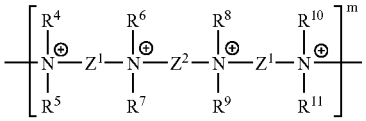

4mA;

(d) a divalent aromatic or aliphatic heterocyclic group, substituted or unsubstituted, containing at least one quaternized nitrogen atom; and $R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl, and mixtures thereof; or in which $R^4$ and $R^6$, or $R^5$ and $R^7$, or $R^8$ and $R^{10}$, or $R^9$ and $R^{11}$ may be components of a bridging alkylene group; and $Z^1$ and $Z^2$ are the same or different divalent hydrocarbon groups with at least 2 carbon atoms, optionally containing a hydroxy group, and which may be interrupted by one or several ether, ester or amide groups.

8. A liquid laundry detergent composition according to claim 1 wherein the stabilizer has a formula selected from the group consisting of:

i) $R^1OCH_2CH(OR^2)CH_2OR^3$ wherein $R^1$ is —C(O)$R^4$, $R^2$ is $R^1$ or H, $R^3$ is $R^1$ or H, and $R^4$ is independently $C_{10}$-$C_{22}$ alkyl or alkenyl comprising at least one hydroxyl group;

ii)

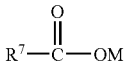

wherein:

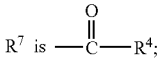

$R^4$ is as defined above in i);

M is $Na^+$, $K^+$, $Mg^{++}$ or $Al^{3+}$, or H; and iii) mixtures thereof.

9. A liquid laundry detergent composition according to claim 1, further comprising a fabric substantive perfume.

* * * * *